US009297611B1

(12) United States Patent
Roccisano

(10) Patent No.: US 9,297,611 B1
(45) Date of Patent: Mar. 29, 2016

(54) BACKUP GUN CARRYING TORSO POCKET

(76) Inventor: Pietro G. Roccisano, Sunrise, FL (US)

( * ) Notice: Subject to any disclaimer, the term of this patent is extended or adjusted under 35 U.S.C. 154(b) by 1471 days.

(21) Appl. No.: 12/023,553

(22) Filed: Jan. 31, 2008

(51) Int. Cl.
*F41C 33/02* (2006.01)

(52) U.S. Cl.
CPC ..... *F41C 33/0209* (2013.01); *A41D 2400/70* (2013.01)

(58) Field of Classification Search
CPC ..... F41C 33/0209; F41C 33/0218; A41D 2400/70; A41D 13/0012; F41H 1/02
USPC ..... 224/623, 625, 646–647, 649, 663, 224/671–672, 984, 901.8, 911
See application file for complete search history.

(56) References Cited

U.S. PATENT DOCUMENTS 4,106,121 A * 8/1978 Belson ..... 2/102
4,266,300 A * 5/1981 Partridge ..... 2/247
5,054,127 A * 10/1991 Zevchak ..... 2/247
5,170,919 A * 12/1992 DeSantis et al. ..... 224/587
5,431,318 A * 7/1995 Garcia ..... 224/192
5,465,425 A * 11/1995 Crispin ..... A41D 13/0012 2/102
5,692,237 A * 12/1997 Bennett ..... F41C 33/00 2/250
5,724,707 A * 3/1998 Kirk et al. ..... 24/3.7
5,829,653 A * 11/1998 Kaiser ..... 224/577
5,961,014 A * 10/1999 Knerr ..... A45F 3/04 224/153
5,991,925 A * 11/1999 Wu ..... 2/102
6,131,198 A * 10/2000 Westrick ..... 2/102
7,200,871 B1 * 4/2007 Carlson ..... 2/103
7,458,491 B2 * 12/2008 Cragg ..... 224/648
7,712,645 B2 * 5/2010 Calkin ..... 224/649
7,845,527 B1 * 12/2010 McMillan et al. ..... 224/232
2007/0295772 A1 * 12/2007 Woodmansee ..... 224/576
2008/0105722 A1 * 5/2008 Howell ..... 224/671

* cited by examiner

*Primary Examiner* — Adam Waggenspack
(74) *Attorney, Agent, or Firm* — H. John Rivzi; Gold & Rizvi, P.A.

(57) ABSTRACT

A chest holster pocket (110) having a firearm receiving section (140) formed between a pocket back panel (122) and a pocket front panel (124). The panels (122, 124) are connected along a bottom and optionally along a lower portion of each of the sides. The panels (122, 124) are coupled via a quick release fastening material (128) disposed along the upper portion of each side. A finger loop (116) is provided for assisting in quick access to a firearm (160) positioned within the receiving section (140). The pocket (110) incorporates a vest fastening material (130) or a PALS/MOLLE (270, 280) system affixed to the exterior of the pocket back panel (122). A pair of upper securing straps (114) is attached to the upper corners to the pocket (110).

12 Claims, 25 Drawing Sheets

BACKUP GUN CARRYING TORSO POCKET

BACKGROUND OF THE INVENTION

1. Field of the Invention

The present invention relates generally to a pocket for holstering a backup gun. More specifically, a pocket worn on the wearer's torso, the pocket being designed to be worn independently or in conjunction with a ballistic panel.

2. Discussion of the Related Art

Law enforcement personnel are trained and outfitted to anticipate dangerous situations. A key instrument the law enforcement person relies upon is a firearm. Such so, that the law enforcement person maintains at least one and sometimes a second backup firearm. There are many reasons why a law enforcement person would maintain a backup firearm. The secondary firearm is commonly concealed and secured to the person via an ankle holster or a shoulder holster. Carrying a firearm in any of these locations can create certain difficulties in quickly accessing the firearm.

Normally, the person stores the firearm on the side of their body opposing the primary hand. There are many circumstances making access to the backup firearm held via the above means difficult or even potentially impossible. One such issue occurs when the person is injured. Another can simply result for the position the person is placed. Yet another can be circumstantial, such as during a physical encounter with a suspect. A firearm in an ankle holster can be difficult to reach, as it is located at the farthest point from one's hands. A shoulder holster is designed to have a firearm grabbed by the hand opposite the arm in which the firearm is secured. It can be difficult to reach if the person is injured on the non-firearm side.

Another method of protection is the use of a ballistics vest. A ballistics vest is an armored garment, often referred to as a "bullet proof vest." The vests typically comprise layers formed of a ballistic resistant fabric, such as Kelvar®. A vest does not protect the wearer by deflecting bullets. Instead, the layers of material catch the bullet and spread its force over a larger portion of the body, absorbing energy more quickly and hopefully bringing it to a stop before it penetrates the body. This tends to deform the bullet, further reducing its ability to penetrate. While a vest can prevent bullet wounds, the wearer still absorbs the bullet's energy, which can cause blunt force trauma. The majority of users experience only bruising, but impacts can still cause severe internal injuries. The material is extremely lightweight, thin, and flexible, making the vest comfortable to wear. The vest further includes a plurality of straps or belts for adjustably securing the vest to the wearer. The straps secure about the wearer's shoulders and waist.

One form factor is directed towards a civilian application and worn between an undershirt and an outer shirt such as the wearer's uniform. The civilian form factor generally incorporates a waist strap, which is secured via Velcro. Another form factor is directed towards a military application and worn externally. Military applications incorporate a plurality of fastening webbing and loops (MOLLE) providing a versatile and configurable tool holder design.

MOLLE, pronounced like Molly, the feminine name, is an acronym for Modular Lightweight Load-carrying Equipment. It is used to define the current generation of load-bearing equipment and rucksacks utilized by the United States Army. The system's modularity is derived from the use of PALS webbing, rows of heavy-duty nylon stitched onto the vest as to allow for attachment of various MOLLE-compatible pouches and accessories.

The Pouch Attachment Ladder System or PALS is a grid of webbing invented and patented by United States Army Natick Soldier Research, Development and Engineering Center used to attach smaller equipment onto load bearing platforms, such as vests and backpacks. PALS consists of webbing sewn onto the load-bearing equipment and corresponding webbing and straps on the attachment. The straps are interwoven between the webbing on each of two pieces and finally snapped into place, making for a very secure fit, which can be detached with moderate effort. The PALS grid consists of horizontal rows of 1" Mil-W-43668 Type III nylon webbing (most commercial vendors use Type IIIa), spaced 1" apart, and reattached to the backing at 1.5" intervals.

Accordingly, it would be desirable to provide an apparatus in which a user can conceal a backup firearm that is readily and easily accessible for use during any dangerous situation.

SUMMARY OF THE INVENTION

Various features and advantages of the invention will be set forth in part in the following description, or may be obvious from the description, or may be learned from practice of the invention.

One aspect of the present invention provides for a torso pocket for holstering a firearm The torso pocket comprising an opening on each of a left and a right side, being connected about a bottom and opening downward. An access grip is located centered on a front panel, proximate a top of the pocket. The rear of the torso pocket assembly comprising a fastening feature for securing the pocket assembly to a vest. The upper section of the pocket assembly comprising a pair of straps (left strap and a right strap) for securing the assembly to shoulder straps of a vest.

Another aspect of the present invention utilizes a finger loop as the access grip extending from a top edge of the pocket front panel, enabling the flap to be swiftly opened, allowing the wearer to quickly access and remove the firearm stored within the pocket.

Another aspect provides a lower fastening feature comprising at least one of Velcro and PALS webbing.

Yet another aspect provides a fastening feature on a front of the torso pocket assembly, wherein the fastening feature replicates the fastening feature provided on a front of the respective vest.

Yet another aspect provides a fastening feature on a front of the torso pocket assembly, wherein the fastening feature replicates the fastening feature assembled to the rear of the pocket assembly.

In yet another aspect, the pocket assembly incorporates accessory securing loops located on the outside of the front panel.

And another aspect provides an assembly securing the torso pocket assembly to a ballistics (bullet proof) vest via a fastening feature located along the lower portion of the pocket assembly and via wrapping of upper securing strap about a vest shoulder strap and securing the upper securing strap to an opposing fastening feature located on the interior of the rear panel.

An additional aspect provides chest holster pocket having an adjustable neck strap and an adjustable waist strap.

An additional aspect incorporates a rear pocket, wherein the rear pocket is configured behind the holster pocket having a pocket access along a top.

Further, a trauma pad, padded insert, and the like can be inserted into either the holster pocket, rear pocket, or both. The inserts can be simply placed or secured via a removable coupler within the pocket region.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS., in which:

FIG. 23 is an isometric view of the

Figure 1:
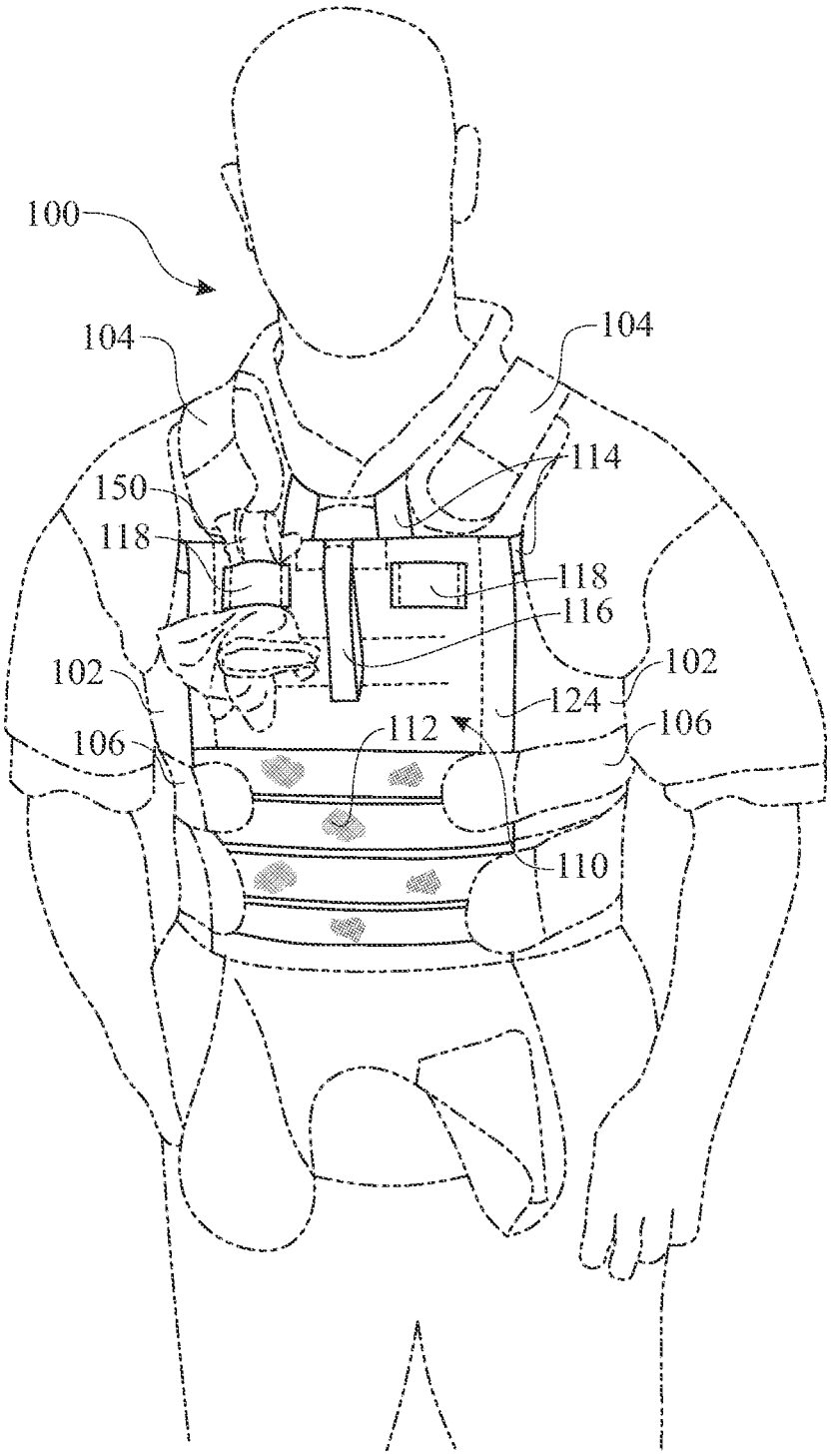
FIG. 1 is a front view of a torso pocket assembly as secured to a ballistics vest, the pocket being shown in a closed state.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Figure 2:
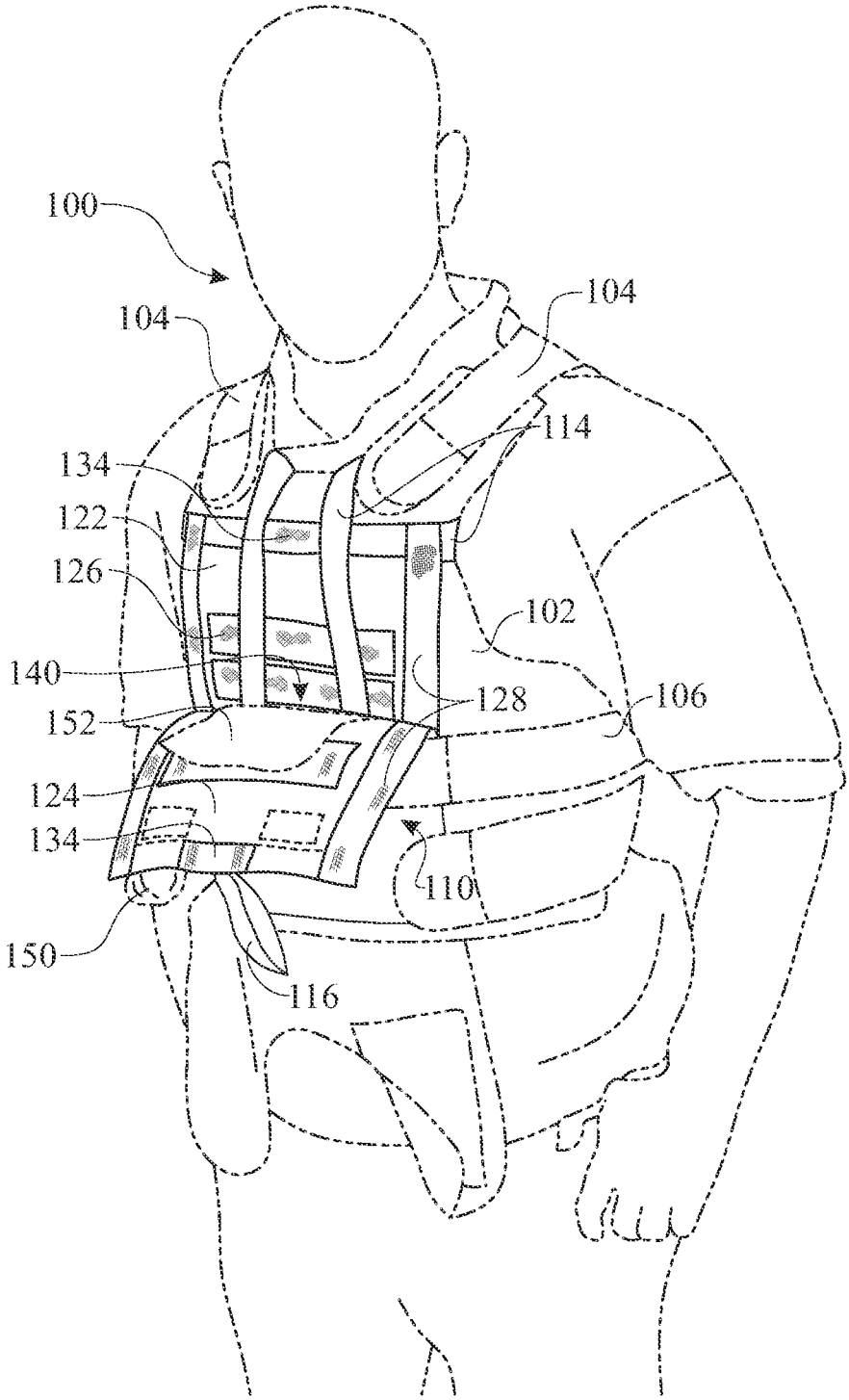
FIG. 2 is a front view of a torso pocket assembly as secured to a ballistics vest of FIG. 1, the pocket being shown in an open state.
Figure 3:
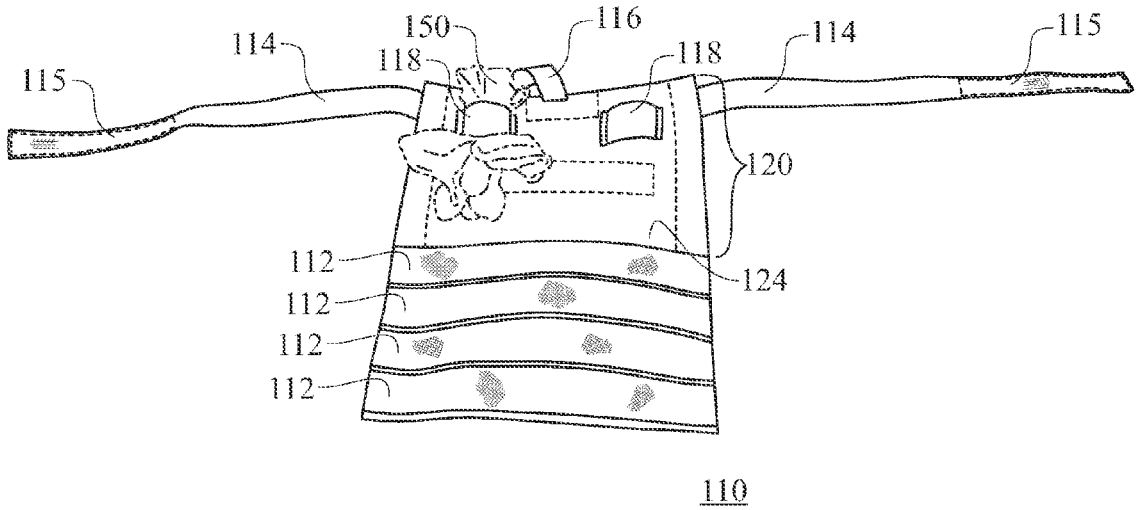
FIG. 3 is an front view of a torso pocket assembly, the pocket being shown in a closed state.
Figure 4:
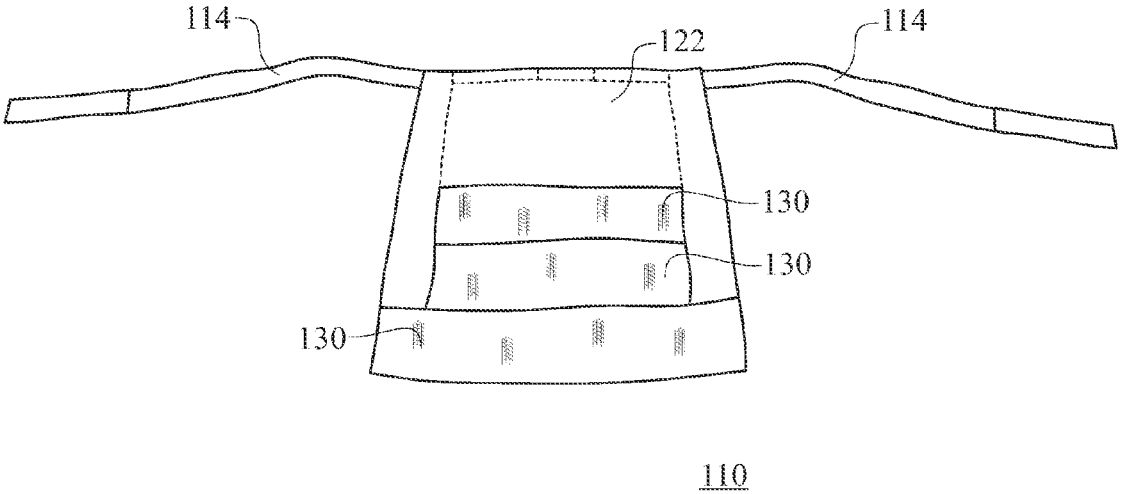
FIG. 4 is a rear view of a torso pocket assembly of FIG. 3, the pocket being shown in a closed state.
Figure 5:
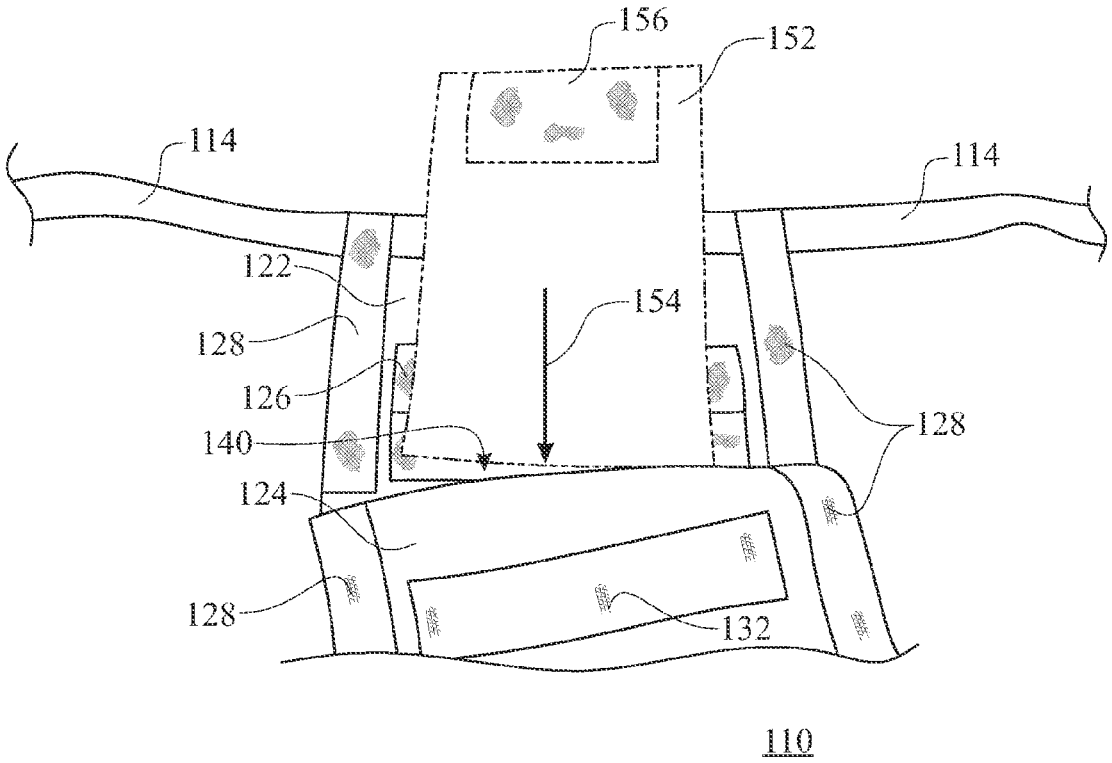
FIG. 5 is a front view of a torso pocket assembly of FIG. 3, the pocket being shown in an open state, further introducing a trauma plate.
Figure 6:
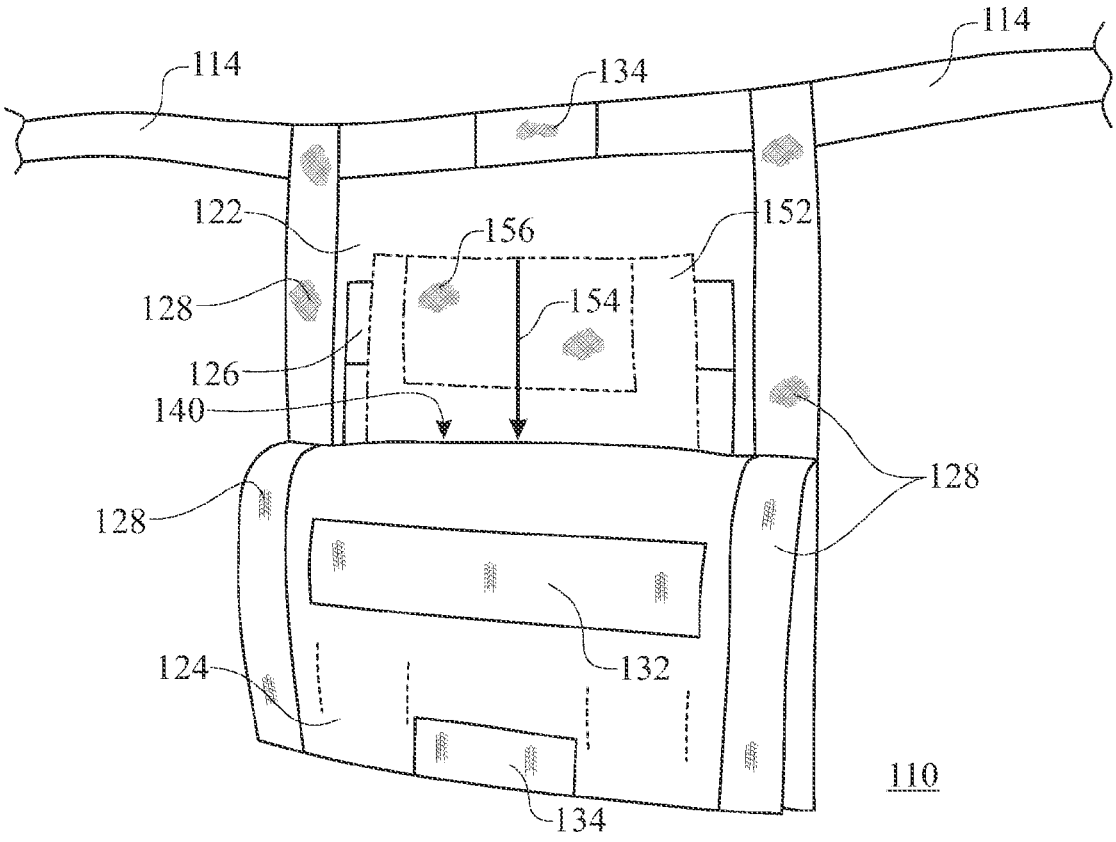
FIG. 6 is a front view of a torso pocket assembly as shown in FIG. 5, the trauma plate being inserted into the pocket.
Figure 7:
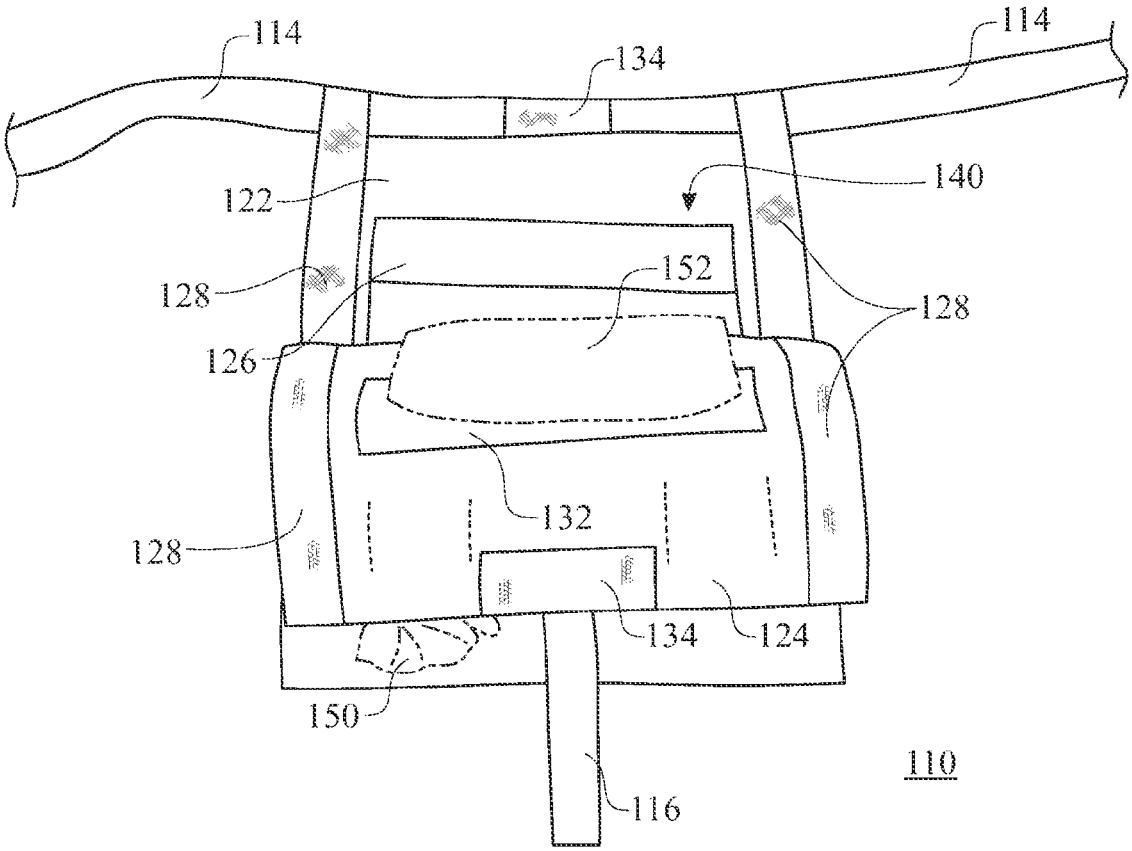
FIG. 7 is a front view of a torso pocket assembly as shown in FIG. 5, the trauma plate shown as inserted and secured into the pocket.

The present invention provides a holster accessory pocket 110, best presented in the exemplary embodiment illustrated in FIGS. 1 and 2. A wearer 100 is illustrated wearing a ballistic (bullet proof) vest 102, the ballistic (bullet proof) vest 102 having a holster accessory pocket 110 secured thereon. The ballistic (bullet proof) vest 102 is secured to the wearer 100 via vest waist straps 106 positioned about a waist of the wearer 100 and a pair of vest shoulder straps 104 about each shoulder of the wearer 100. The holster accessory pocket 110 is fastened to a front, upper portion of the ballistic (bullet proof) vest 102 by wrapping a upper securing straps 114 about each of the vest shoulder straps 104 and securing the distal end of the upper securing straps 114 to a pocket rear internal fastening panel 126 of the holster accessory pocket 110. The pocket rear internal fastening panel 126 is fabricated of a compatible fastening material respective to the material affixed to the upper securing straps 114, such as a dense hook and loop fastening system commonly referenced by the trade name Velcro®. The holster accessory pocket 110 is fastened to a front, lower portion of the ballistic (bullet proof) vest 102 by a fastening feature (pocket to vest fastening material 130 such as Velcro® of FIG. 4 or PALS webbing 260 of FIG. 14). One half of the fastening feature being disposed upon the backside of the holster accessory pocket 110 and the opposing half of the fastening feature is disposed upon the front of the ballistic (bullet proof) vest 102. The vest waist straps 106 are secured to the pocket front coupling feature 112, which are affixed to the lower portion of the front of the holster accessory pocket 110. The pocket front coupling feature 112 shown utilizes a dense hook and loop material and can be provided via either a single or a plurality of strips (as shown). The pocket front coupling feature 112 can utilize any known coupling feature for securing accessories or tools to the front of the holster accessory pocket 110. A holster access finger loop 116 is assembled to the top center of the pocket front panel 124. At least one accessory securing loop 118 is attached to the front of the holster accessory pocket 110; the accessory securing loops 118 provide a means for securing items such as safety gloves 150.

Additional details of the holster accessory pocket 110 are presented in FIGS. 3 through 7. The holster accessory pocket 110 is fabricated having a pocket back panel 122 and a pocket front panel 124, each preferably being of a rectangular shape, interconnected along a lower edge, and optionally secured vertically along a lower portion of each of a left and a right side. The side configuration provides a pocket opening section 120 along the upper portion of the pocket assembly holster accessory pocket 110. A quick release, side edge fastener 128 is incorporated along each of a left side and a right side of the pocket panels 122, 124. An optional top fastening strip 134 is incorporated proximate a center of a top portion of each of the pocket back panel 122 and pocket front panel 124. The fasteners 128, 134 are preferably of a dense hook and eye fastener similar to the material available under the trade name Velcro®. The desired fasteners 128, 134 would provide a reliable fastening interface capable of being opened quickly and easily. It is recognized that other fastening interface designs, which provide a quick release coupling feature, can be utilized. A holster access finger loop 116 is attached to the upper, center of the pocket front panel 124, providing the wearer with a device for assisting in the quick access of the firearm 160 stored within the pocket assembly 110. The two panels 122, 124 form a firearm receiving section 140 between them. The pocket assembly 110 is secured to the ballistic (bullet proof) vest 102 via several optional securing means. A pocket to vest fastening material 130 is affixed to the exterior of the lower rear portion of the pocket assembly 110, used for securing the lower portion of the pocket assembly 110 to the opposing connecting portion disposed upon the ballistic vest 102. The pocket front coupling feature 112 is affixed to the exterior of the lower front portion of the pocket assembly 110 as a means for transposing the features of the connecting portion disposed upon the ballistic vest 102 to the front of the pocket assembly 110. The upper portion of the pocket assembly 110 is secured by looping the upper securing straps 114 between the vest shoulder straps 104 and the shoulder of the wearer 100. The upper securing straps 114 are then secured by coupling a pocket shoulder strap fastener 115 (affixed to each distal end of the upper securing straps 114) to the pocket rear internal fastening panel 126 within the firearm receiving section 140.

The panels 122, 124 can be fabricated of any material, based upon the specific application. The panels can be fabricated of canvas, heavy cotton, leather, polyester, Kevlar, and the like. Additionally, the panels can be fabricated of a composite of a blend of the above or other materials. The edges of the panels are finished to avoid any fraying. The edge finishing process can be of any known means, including fold and stitching, edging, surging, and the like. The holster access finger loop 116, accessory securing loops 118, and other similar components can be fabricated from canvas webbing.

An insertable trauma pad 152 can be inserted 154 into the pocket, providing additional safety to the wearer. The insertable trauma pad 152 can include a plate fastening strip 156, wherein the plate fastening strip 156 can be utilized to removably fasten the insertable trauma pad 152 within the pocket. The plate fastening strip 156 is affixed to the pocket front internal fastening strip 132. The trauma pads 152 can be fabricated of any soft, pliable material, and optionally include additional ballistic protection. Examples include rubber, foam, quilted materials, as well as Kevlar®, and the like.

Figure 8:
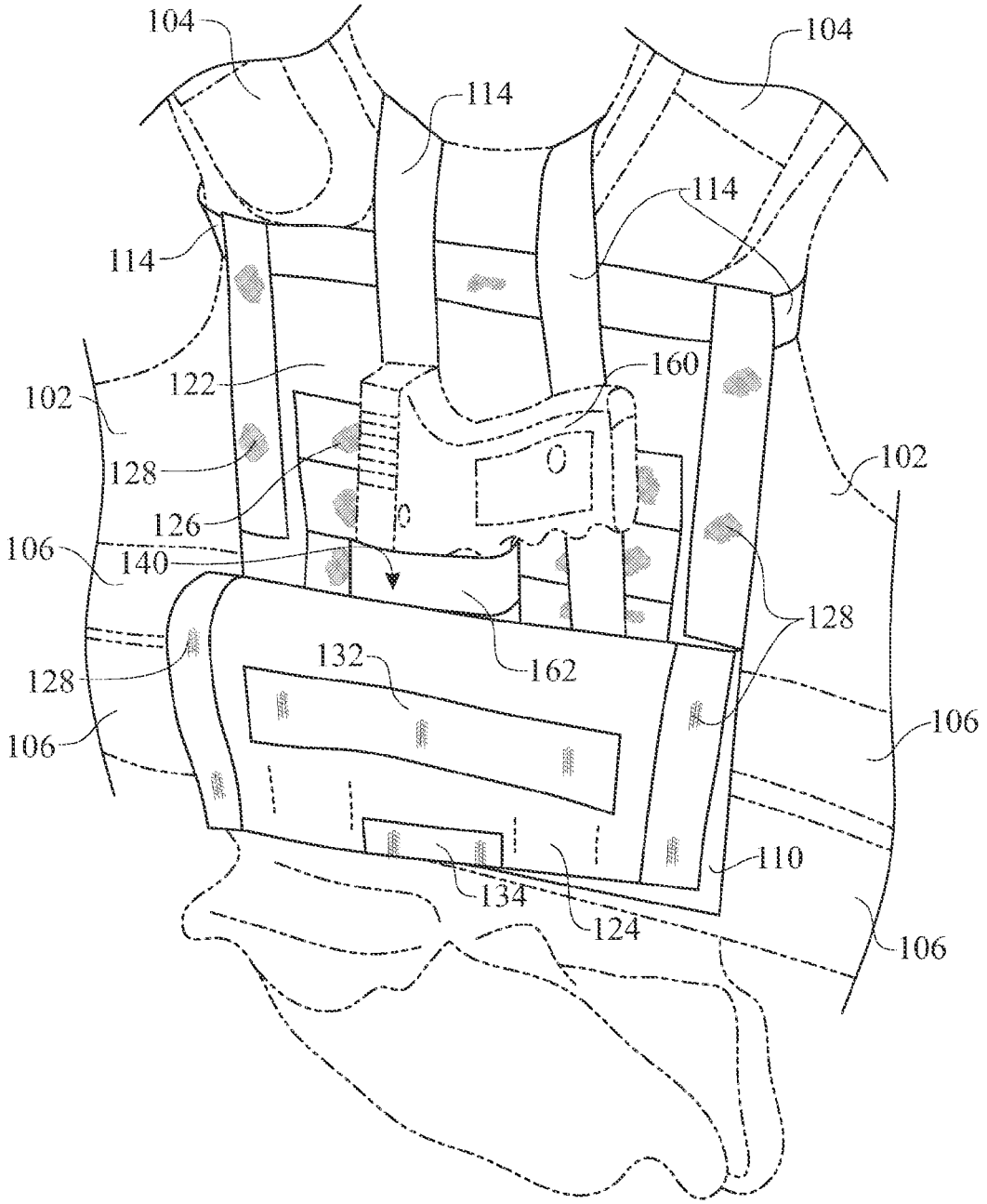
FIG. 8 is a front view of a torso pocket assembly of FIG. 1, the pocket being shown in an open state, further introducing a firearm and respective holster.
Figure 9:
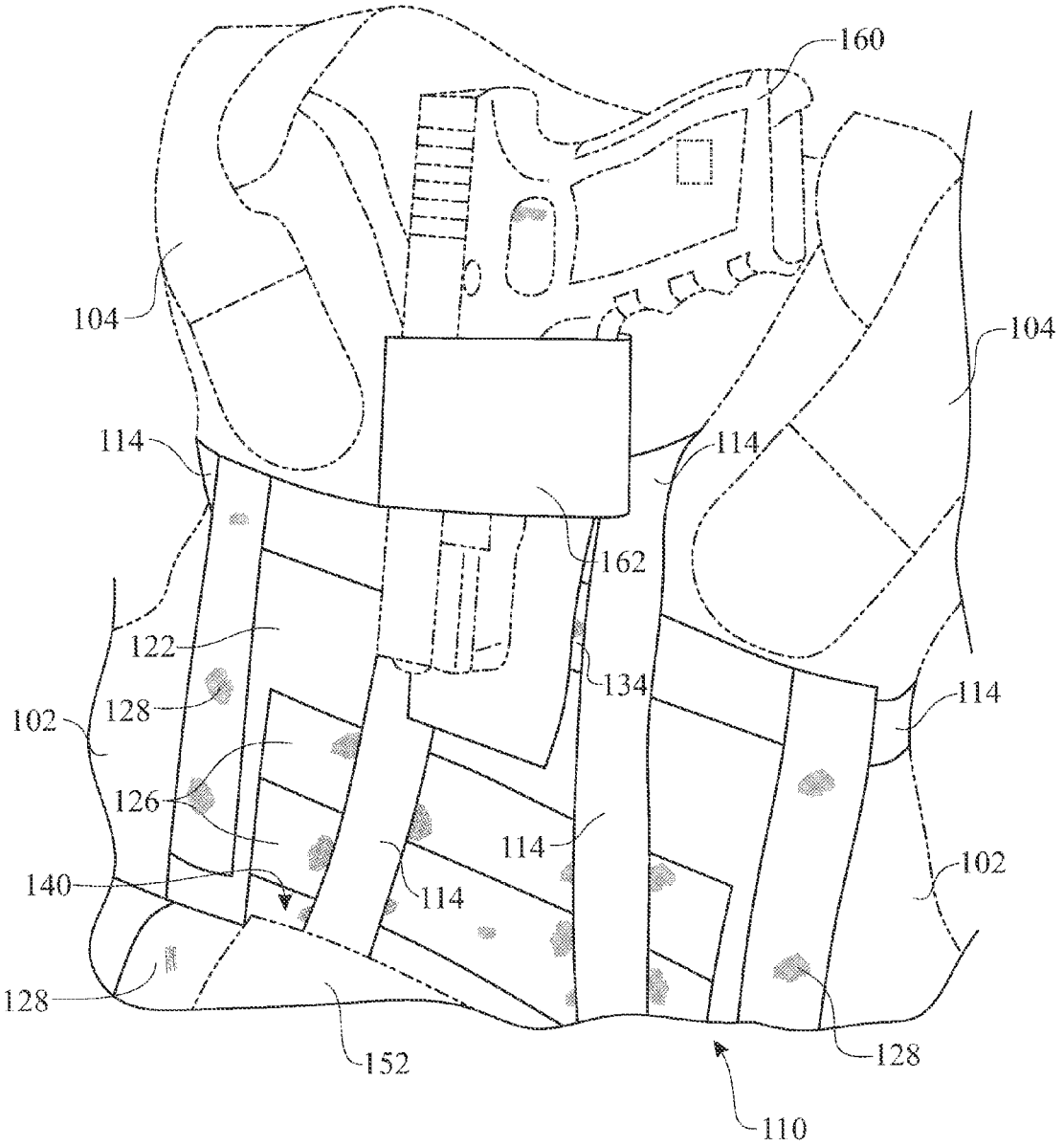
FIG. 9 is an enlarged, front view of a torso pocket assembly of FIG. 8, the firearm and respective holster shown being removed from the pocket.

The firearm 160 is stored within the firearm receiving section 140 of the pocket assembly 110 as presented in FIGS. 8 and 9. The firearm 160 is placed within a holster 162 and inserted into the firearm receiving section 140. Details of the holster 162 will be presented via FIGS. 10 through 12 which will be discussed later herein. The holster 162 is secured to the pocket rear internal fastening panel 126 via a quick release, fastening interface such as Velcro® or similar. By securing the insertable trauma pad 152 to the pocket front internal fastening strip 132 of the pocket back panel 122, when the wearer pulls open the pocket assembly 110, the insertable trauma pad 152 is folded outward providing completely unobstructed access to the firearm 160. The configuration provides the wearer 100 with optimal access to the firearm 160 using both their left and right hands. By securing the upper securing straps 114 to the pocket rear internal fastening panel 126 within the pocket region of the pocket assembly 110, the configuration minimizes any potential interference of the upper securing straps 114 respective to the hasty removal of the firearm 160.

Figure 10:
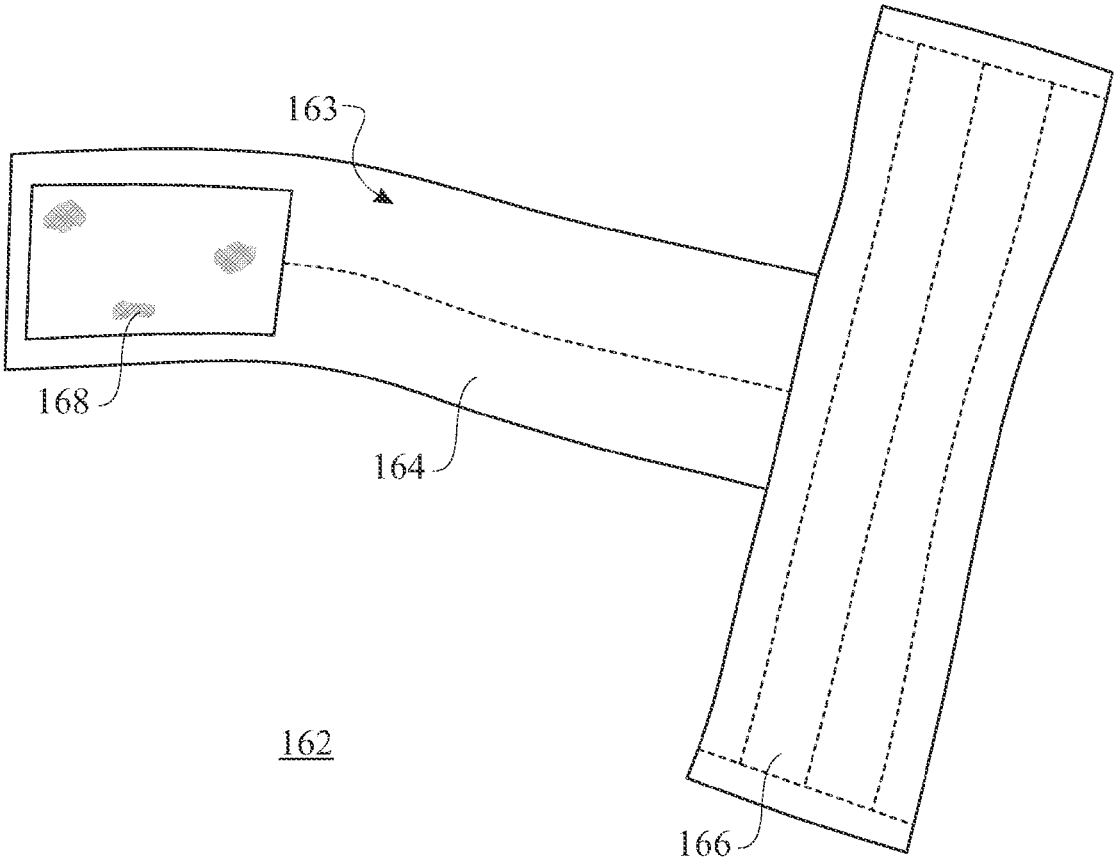
FIG. 10 is a front view of a firearm holster, shown in an open configuration.
Figure 11:
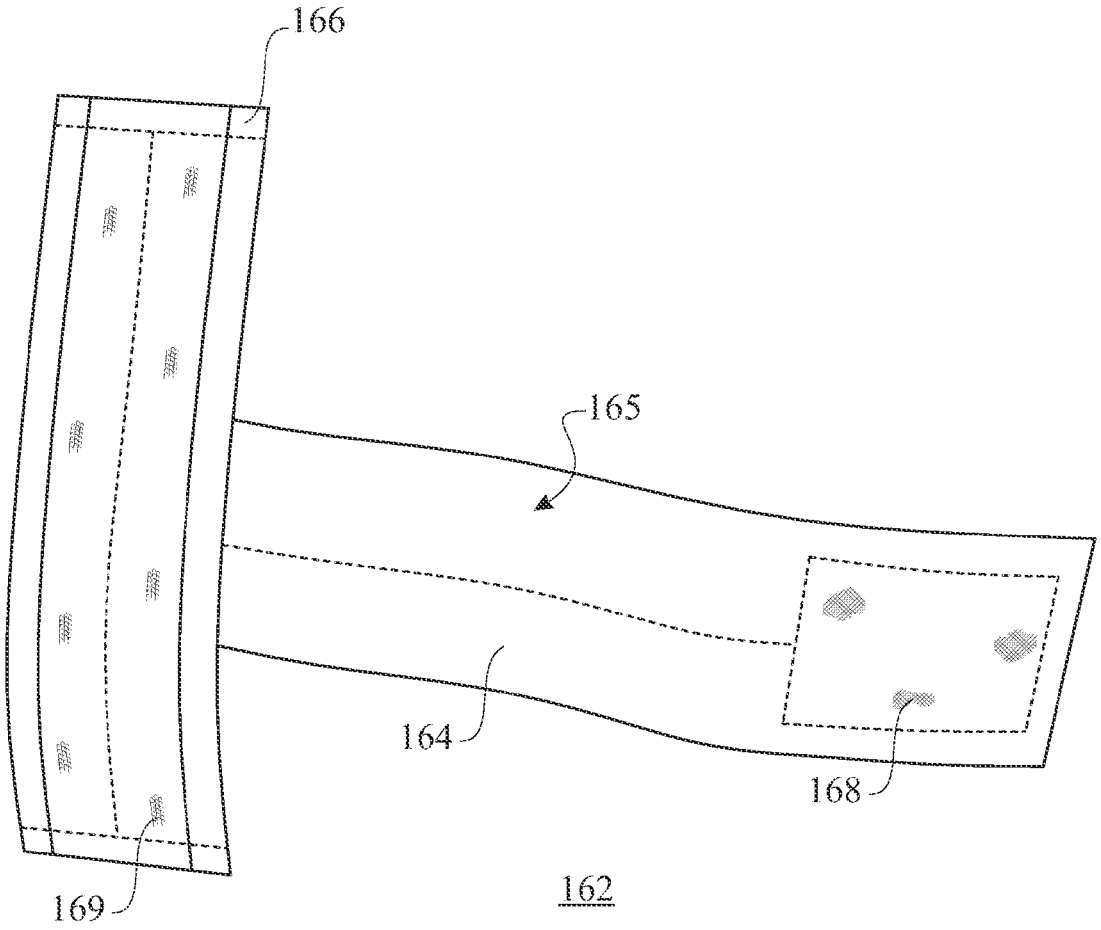
FIG. 11 is a rear view of the firearm holster previously presented in FIG. 10, shown in an open configuration.
Figure 12:
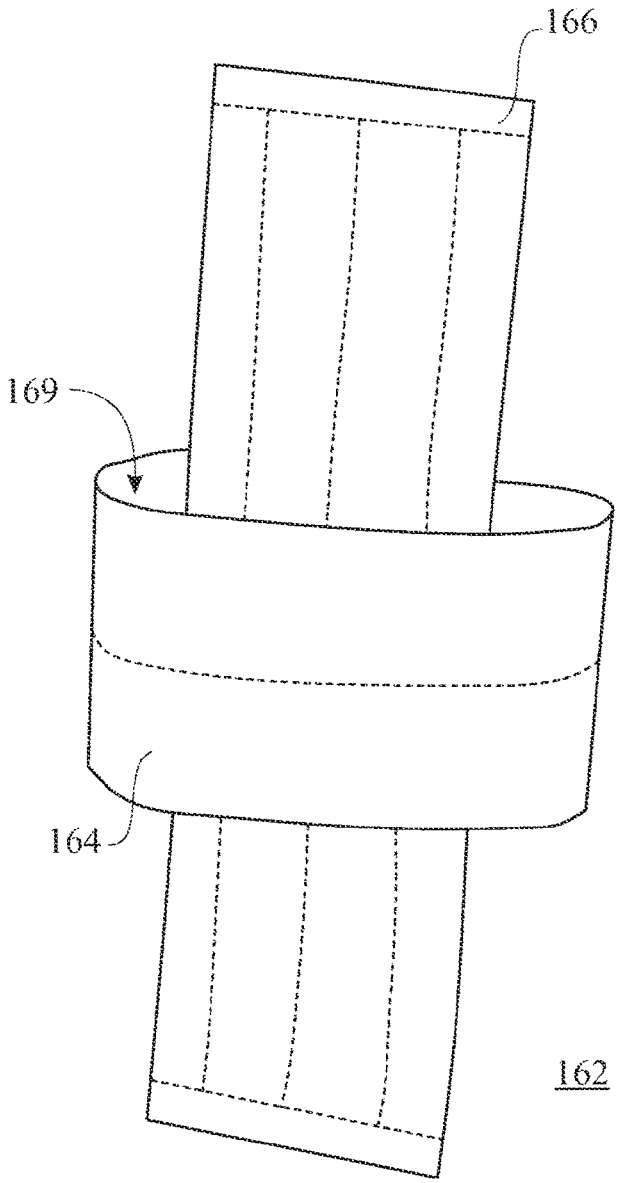
FIG. 12 is a front view of the firearm holster previously presented in FIG. 10, shown in a looped configuration.

An exemplary embodiment of the holster 162 is presented in FIGS. 10 through 12. The firearm contacting side 163 is presented in FIG. 10. The exposed side 165 is presented in FIG. 11. The assembled/looped view is shown in FIG. 12. The design of the holster 162 ensures against any interference with the operation of the firearm 160. The holster 162 is fabricated having a holster wrap panel 164 and a mounting panel 166; the mounting panel 166 being assembled perpendicularly to an end of the holster wrap panel 164. A wrap fastening material 168 is affixed to both the firearm contacting side 163 and the exposed side 165 of the holster 162 proximate the end of the holster wrap panel 164 opposing the mounting panel 166. A mount panel fastening material 169 is affixed to the exposed side 165 of the mounting panel 166 preferably covering the majority of the exposed side 165 of the mounting panel 166, providing a means for securing the wrap fastening material 168 to the mount panel fastening material 169 as well as the pocket rear internal fastening panel 126. The holster wrap panel 164 is formed into a loop having a snug fit about the firearm 160. The ends of the mounting panel 166 remain available for utilizing the exposed portion of the wrap fastening material 168 for securing the holster 162 within the firearm receiving section 140. A canvas webbing material can be used for fabricating the holster 162. A dense hook and eye material can be utilized as the fastening material.

Figure 13:
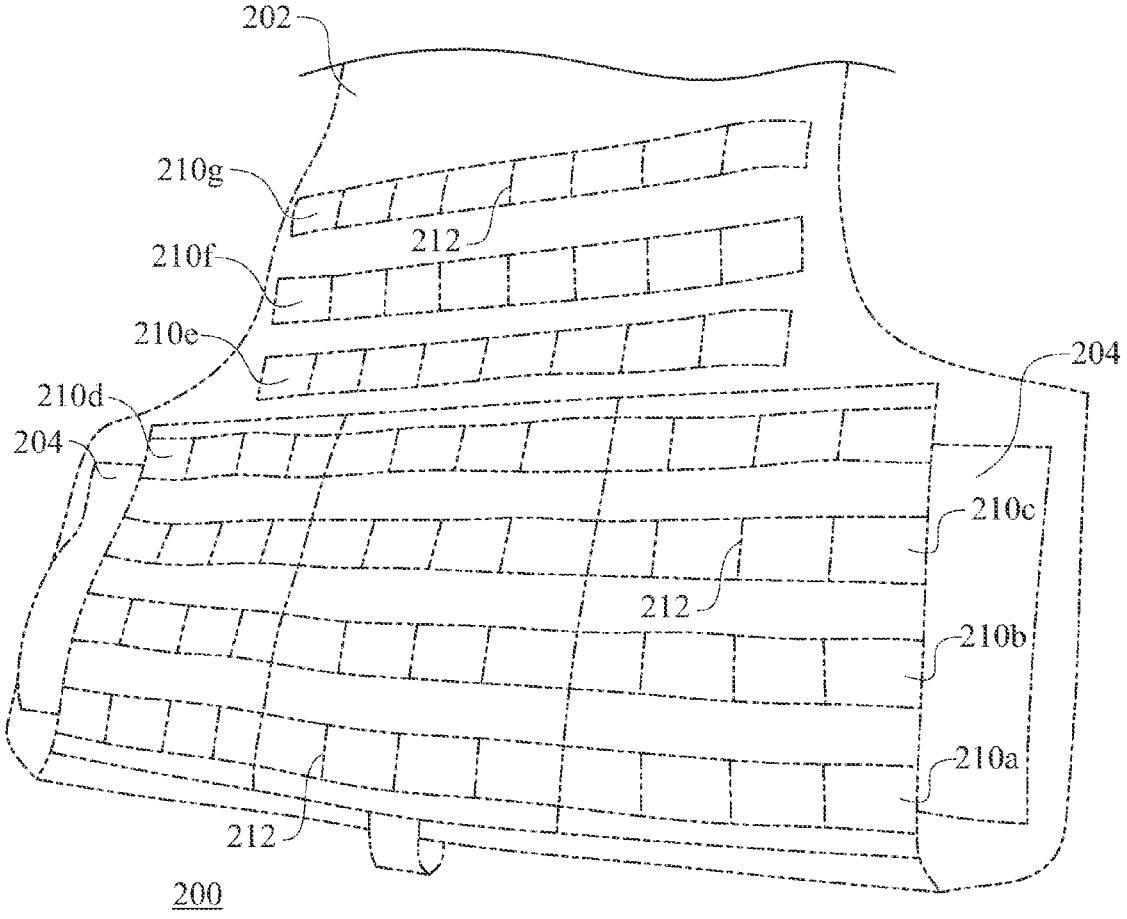
Prior Art FIG. 13
FIG. 13 is a front view of a military version of a ballistics vest including MOLLE or PALS.

A military ballistic vest 200 is best shown in FIG. 13. The military ballistic vest 200 is known prior art, comprising a ballistic vest 202 incorporated a MOLLE (Modular Lightweight Load-carrying Equipment) configuration. MOLLE equipment comprises a PALS (Pouch Attachment Ladder System) attachment configuration. The PALS is fabricated via a plurality of MOLLE webbing strips 210, presented as individually lettered (a, b, c, d, e, f, and g) for clarity of the assembly instructions to be subsequently presented herein. The webbing strips 210 are secured to the ballistic vest 202 at each end, having individual loops defined by a plurality of MOLLE stitching 212 stitched vertically. A waist securing member 204 can be affixed to the lower portion of each of the left and right sides of the ballistic vest 202 for securing the military ballistic vest 200 about a wearer's waist. The waist securing member 204 can be any fastening means, including dense hook and loop material, hook and eyes, ties, and the like.

Figure 14:
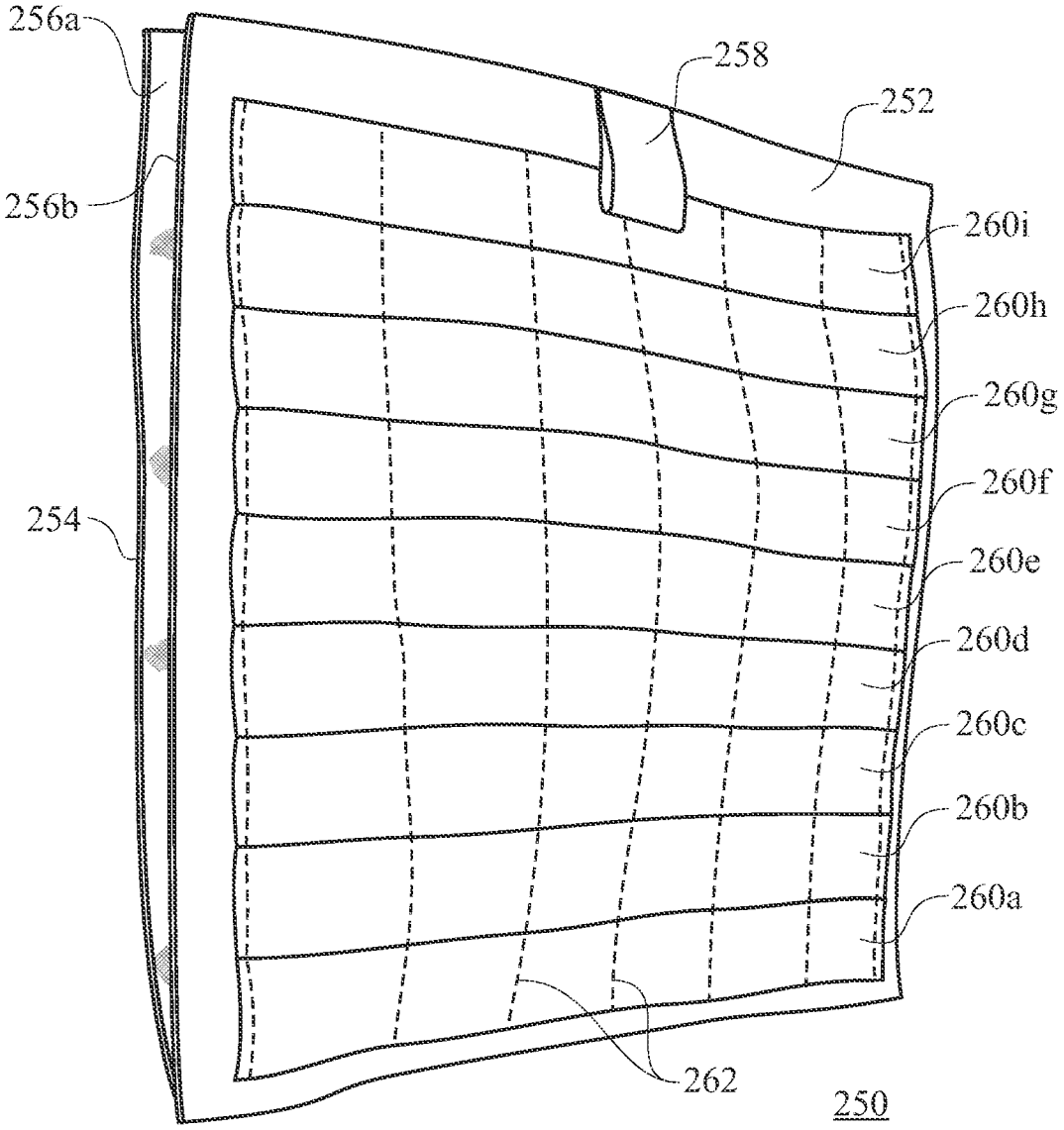
FIG. 14 is a front view of a chest firearm holster comprising a PALS webbing configuration.
Figure 15:
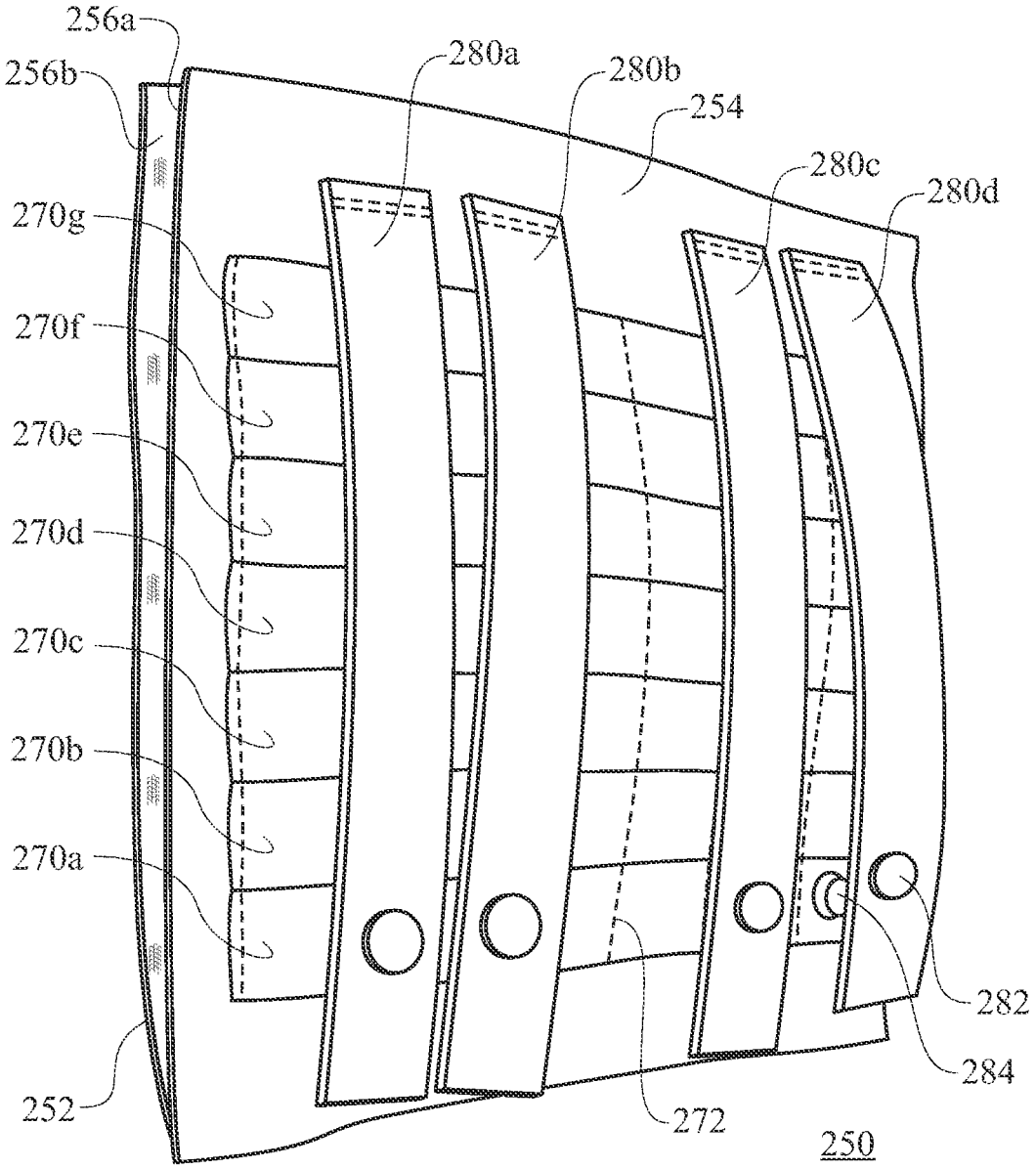
FIG. 15 is a rear view of the chest firearm holster presented in FIG. 14.
Figure 16:
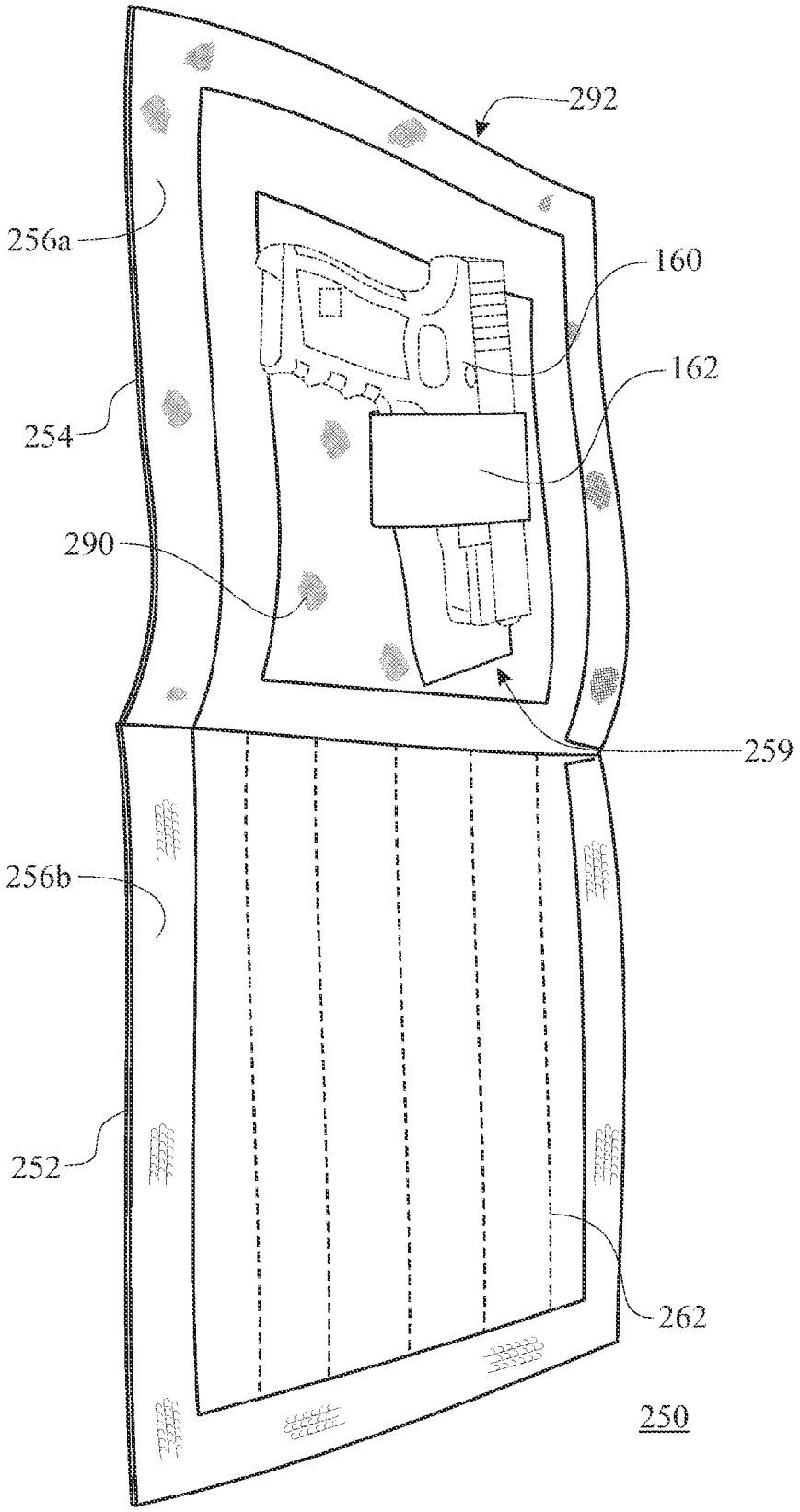
FIG. 16 is a front view of the chest firearm holster presented in FIG. 14, shown in an opened configuration.

Another exemplary embodiment such as the holster accessory pocket 250 is best presented in FIGS. 14 through 16, wherein FIG. 14 presents a front view, FIG. 15 presents a rear view, and FIG. 16 presents an exposed holster (opened pocket) view. The holster accessory pocket 250 comprising a pocket front panel 252 and a pocket rear panel 254 being hingably connected to each other about a bottom. A firearm receiving section 259 is formed between the pocket front panel 252 and the pocket rear panel 254. The pocket front panel 252 and respective pocket rear panel 254 are secured to each other along each the two vertical sides via a side edge fastener 256. A first side edge fastener **256*a* provides a first portion of the fastening material and is affixed to the interior side of the pocket rear panel 254 about its perimeter. A side edge fastener 256*b* provides the opposing portion of the fastening material being affixed to the interior side of the pocket front panel 252 about its perimeter. A holster access finger loop 258 is disposed to the external, top center region of the pocket front panel 252, providing a grip to assist the user in quickly separating the pocket front panel 252 from the pocket rear panel 254, thus opening the firearm receiving section 259. A plurality of PALS webbing 260 and PALS webbing 270 are disposed on the exterior sides of each of the pocket front panel 252 and the pocket rear panel 254 respectively. Each front PALS 260 comprising a plurality of fastening loops defined via a plurality of MOLLE defining stitching 262. The front PALS 260 is used for securing accessories to the holster accessory pocket 250. Each rear PALS 270 comprising a plurality of fastening loops defined via a plurality of MOLLE defining stitching 272. A plurality of MOLLE weaving strips 280 are oriented generally perpendicular to the PALS webbing 270, each having a first end that is affixed to the exterior, along the top edge of the pocket rear panel 254. The rear PALS 270 is used in a weaving manner for securing the holster accessory pocket 250 to the military ballistic vest 200. A snap button & socket 282 is disposed at the distal end of each MOLLE weaving strip 280. A snap stud & eyelet 284 is disposed upon the pocket rear panel 254 in a location respective to each MOLLE weaving strip 280 for securing the free end of the MOLLE weaving strips 280 to the pocket rear panel 254**.

The firearm 160 is placed into the holster 162 and inserted into the firearm receiving section 259, being secured therein via a pocket rear internal fastening strip 290 as best illustrated in FIG. 16. The pocket rear internal fastening strip 290 is affixed to the interior of the pocket rear panel 254.

Figure 17:
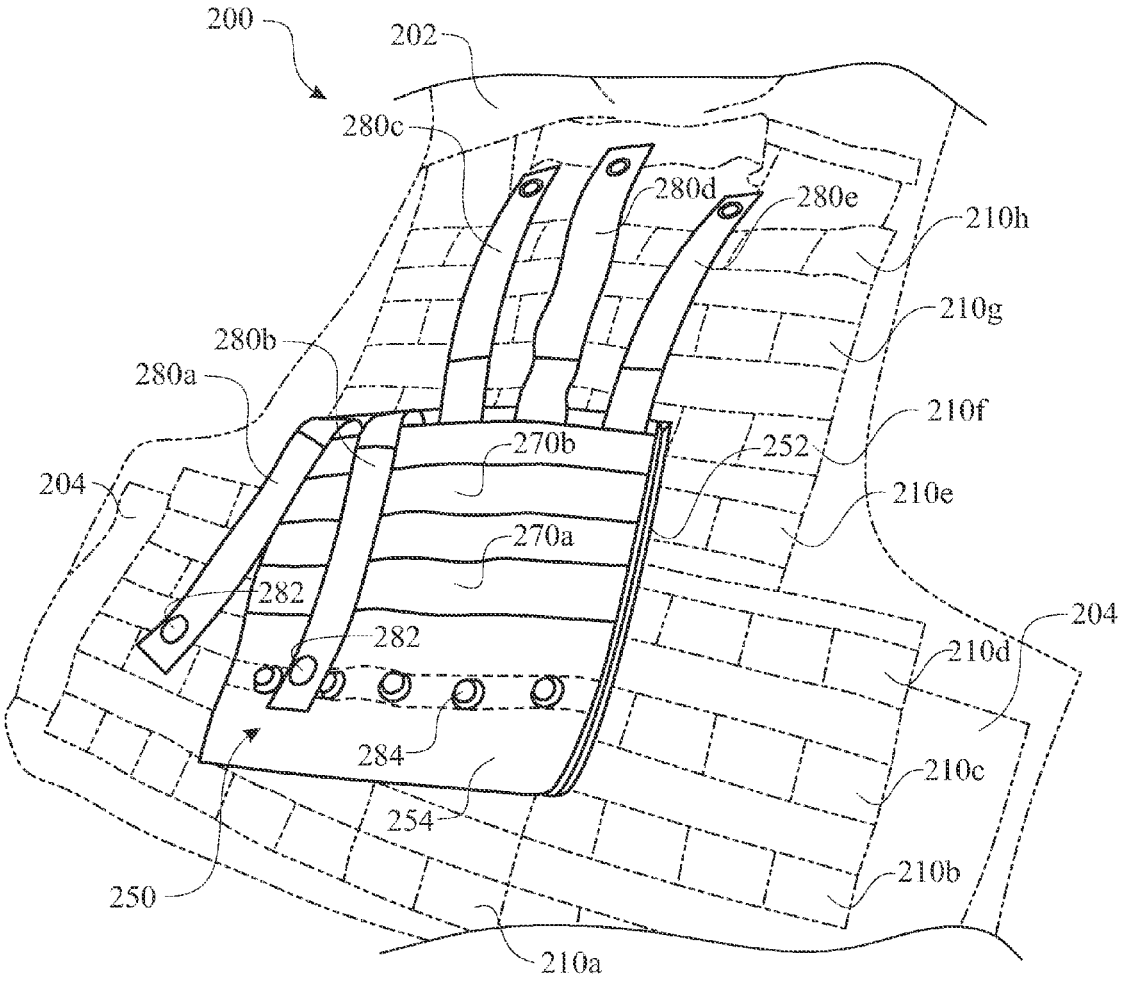
FIG. 17 is a rear view of the chest firearm holster laying on the front of a MOLLE vest comprising a PALS webbing configuration.
Figure 18:
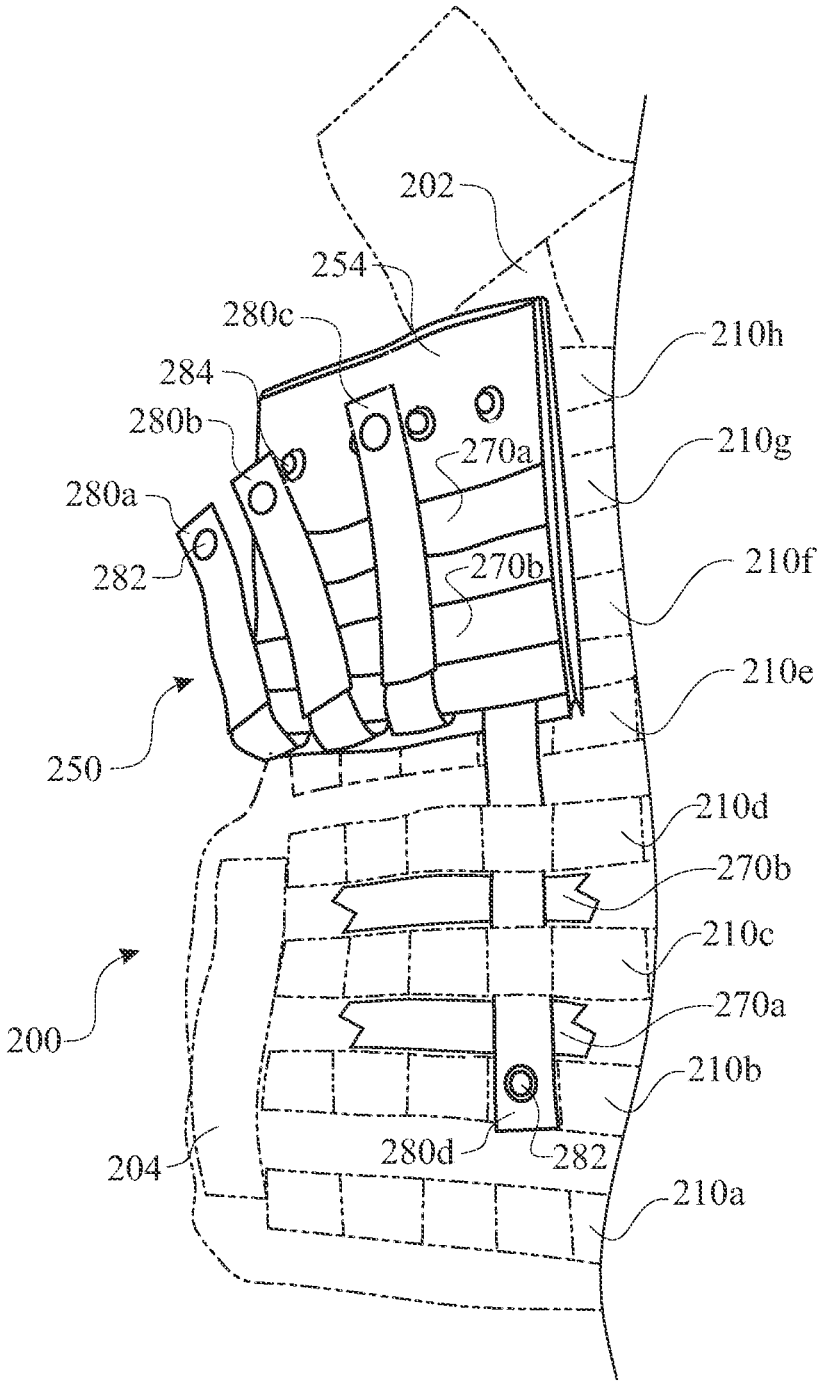
FIG. 18 is a rear view of the chest firearm holster presenting the assembly of the holster to the front of the MOLLE vest.

The means for securing the holster accessory pocket 250 to the military ballistic vest 200 as best illustrated in FIGS. 17 and 18. The MOLLE weaving strips 280 are woven, alternating through each MOLLE webbing strips 210 of the military ballistic vest 200 and PALS webbing 270 of the holster accessory pocket 250. The assembly initiates by determining which securing strip 210 would be the top strip. The exemplary embodiment presents webbing 210*d* as being the top strip. The assembler inserts the MOLLE weaving strip 280*d* through the respective loop of the MOLLE webbing strip 210*d* as illustrated in FIG. 18. The assembler continues with the insertion each of the remaining MOLLE weaving strips 280 (c, b, and a) through the respective loops of MOLLE webbing strip 210*d*. The assembler then flips the holster accessory pocket 250 downward and weaves each of the MOLLE weaving strips 280 through the PALS webbing 270*b* of the holster accessory pocket 250 as shown in the cutaway section of PALS webbing 270*b*. The assembly process continues weaving each of the MOLLE weaving strips 280 (a, b, c, d) through each respective loop of the next aligned webbing strip 210*c*. The process continues weaving each of the MOLLE weaving strips 280 through the PALS webbing 270*a* of the holster accessory pocket 250 as shown in the cutaway section of PALS webbing 270*a*. Lastly, each of the snap button & sockets 282 are secured to the respective snap stud & eyelets 284.

Figure 19:
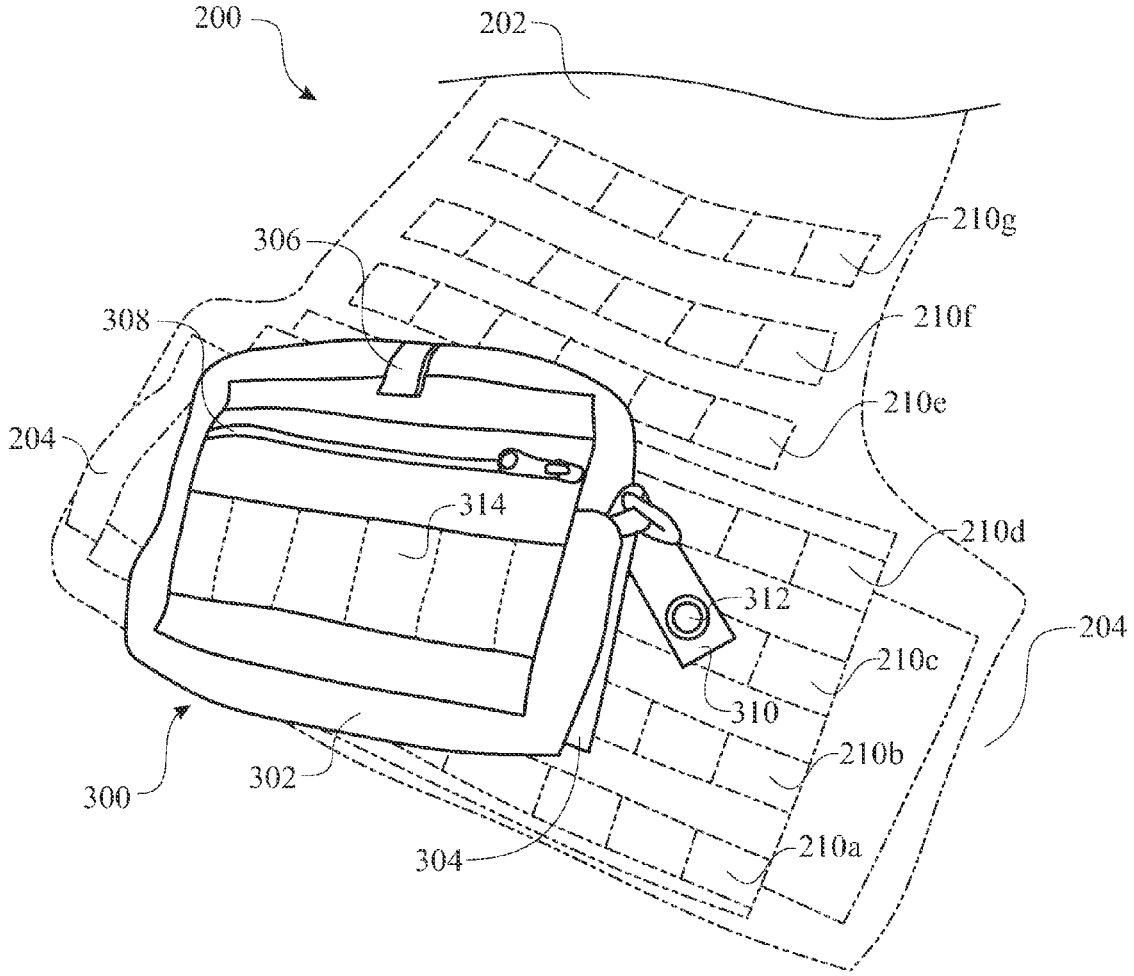
FIG. 19 is a front view of an alternate chest firearm holster, further comprising an exemplary accessory pocket section.
Figure 20:
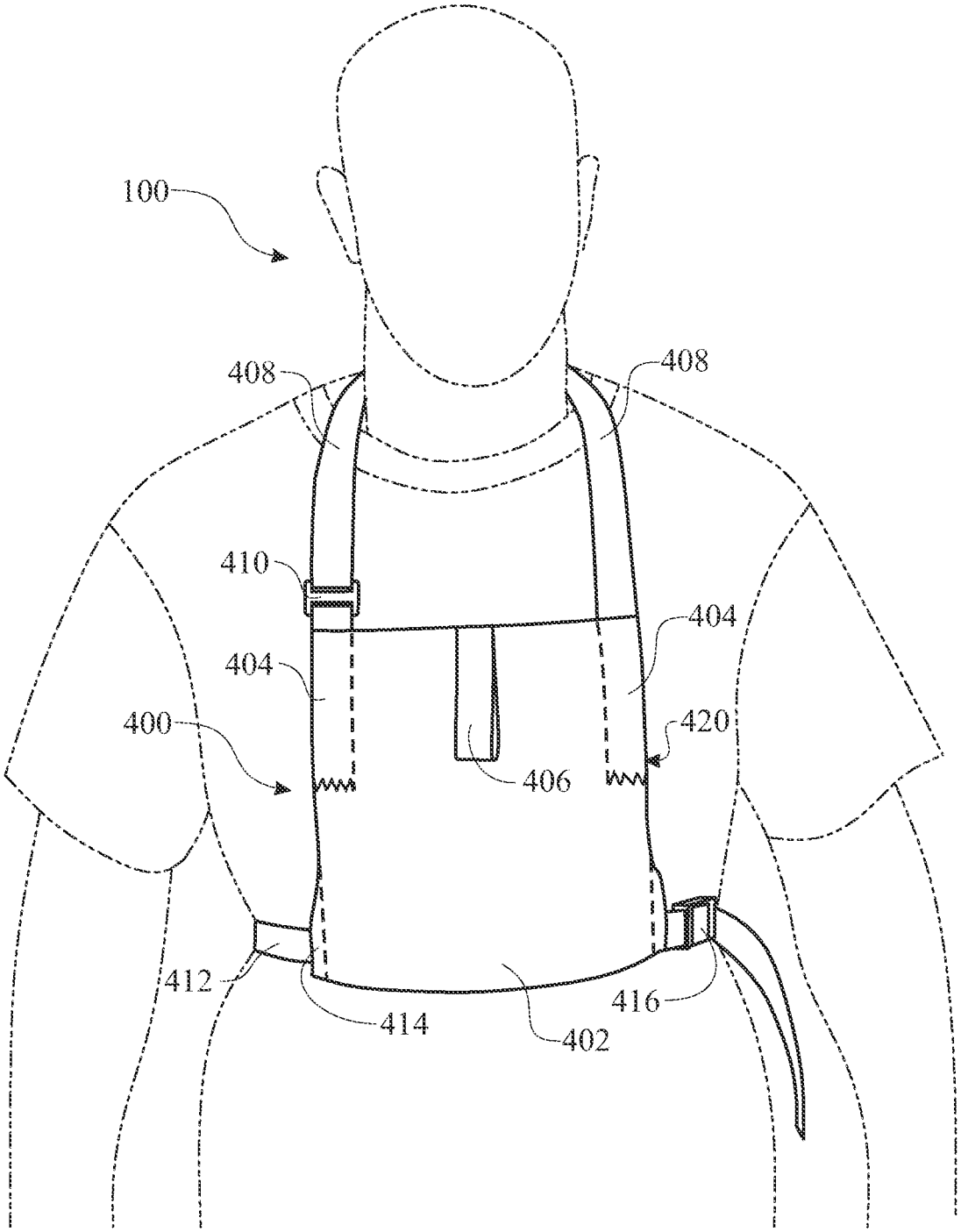
FIG. 20 is a front view of yet another exemplary chest firearm holster mounting scheme embodiment.
Figure 21:
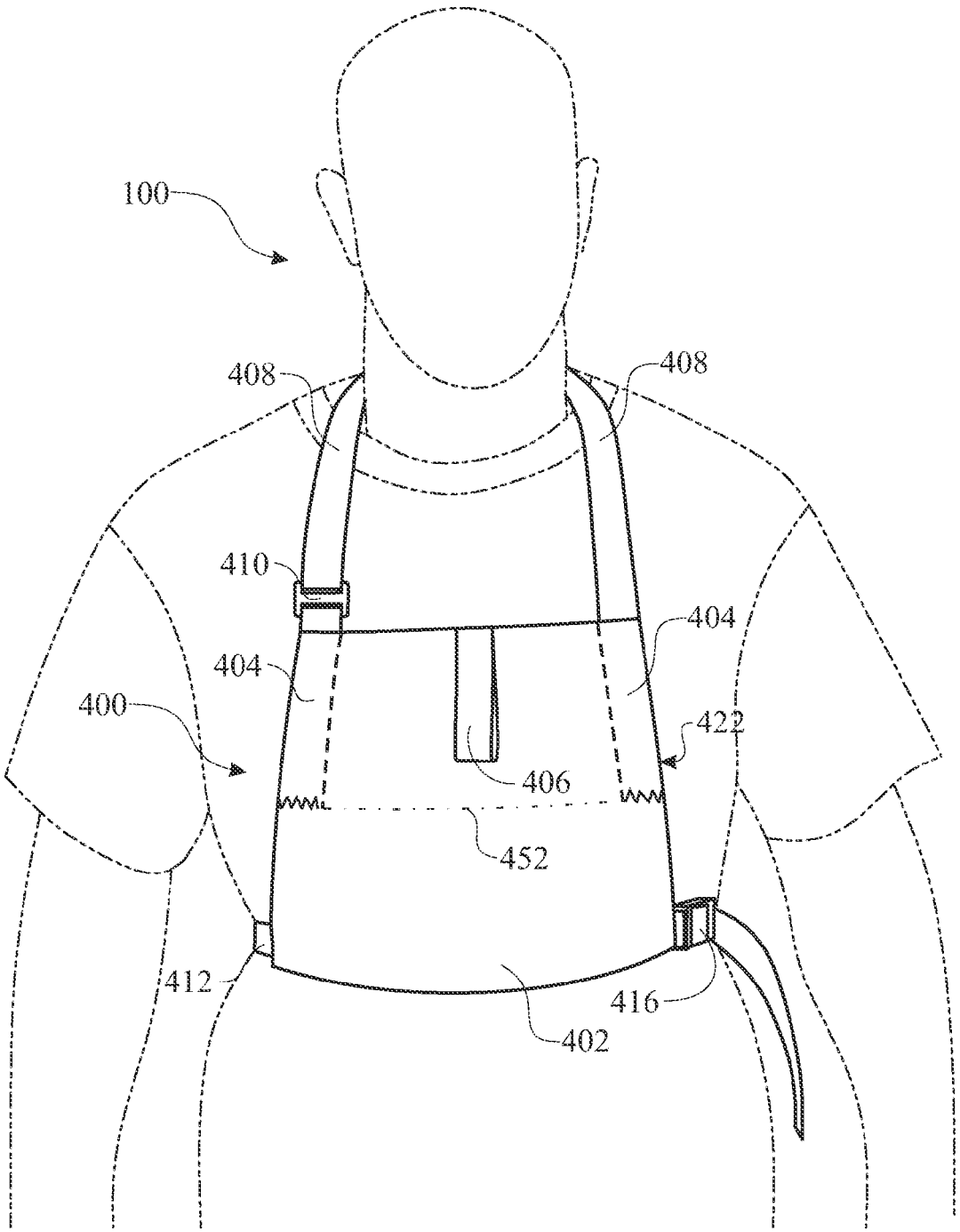
FIG. 21 is a front view of a modified version of the exemplary chest firearm holster of FIG. 20.
Figure 22:
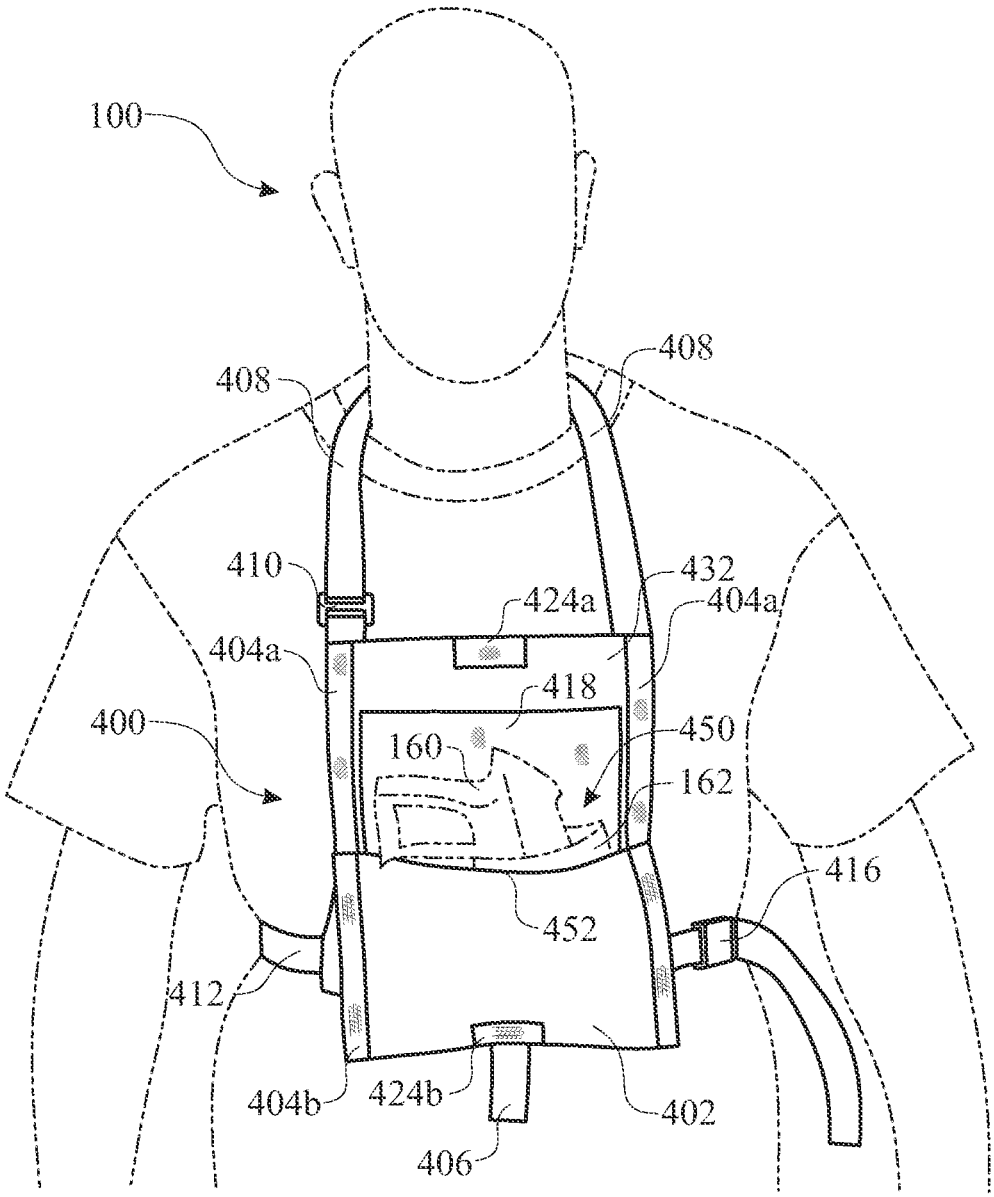
FIG. 22 is a front view of the exemplary chest firearm holster of FIG. 20, shown in an open holster configuration.

Yet another exemplary embodiment of the holster pocket is an accessory and firearm holster pocket combination 300 incorporating an accessory pocket section 302 as shown in FIG. 19. The accessory and firearm holster pocket combination 300 includes a firearm pocket section 304 as in the previous embodiments, having the accessory pocket section 302 integrated into the front panel of the firearm pocket section 304. The accessory pocket section 302 can be utilized for holding magazines, ammunition, first aid kits, binoculars, radios, tools, equipment, or any other accessory. A holster access finger loop 306 is assembled to the top, center of the accessory pocket section 302, providing a means for the wearer 100 to quickly access the holster/article receiving section. The accessory pocket section 302 incorporates an accessory pocket zipper 308 providing an accessing means to the storage region of the pocket. A PALS webbing strip 314 can be affixed to a front of the accessory pocket section 302 for securing additional utility items. A MOLLE system is incorporated in a back of the accessory pocket section 302 for securing the accessory and firearm holster pocket combination 300 to the military ballistic vest 200. The MOLLE system comprising the common components, including a MOLLE weaving strip 310 having a snap 312 disposed thereon, PALS webbing (similar to PALS webbing 270 of FIGS. 17, 18), and a plurality of snap stud and eyelets (similar to snap stud & eyelets 284 of FIGS. 17, 18). The accessory and firearm holster pocket combination 300 would be assembled to the military ballistic vest 200 in the same manner as presented in FIGS. 17 and 18.

Another exemplary embodiment of the holster pocket is a chest firearm holster 400 as illustrated in FIGS. 20 through 25. The chest firearm holster 400 includes a firearm holster front panel 402 connected to a rear pocket front panel 432 along a lower edge and optionally along a lower portion of each side forming a holster pocket 450 therein. A firearm holster rear panel 430 can optionally be incorporated behind the rear pocket front panel 432 providing a rear pocket 440. Alternately, the firearm holster rear panel 430 and the rear pocket front panel 432 can be considered as a single member eliminating the rear pocket 440. The non-coupled portion of each side has a side edge fastener 404 disposed along each of a left and a right side therein between a top edge of the panels and a front panel fold 452 for temporarily securing the upper portion of each of the firearm holster front panel 402 and the rear pocket front panel 432. The side edge fastener 404 comprising a first coupling portion 404*a* and a second coupling portion 404*b*. A holster access finger loop 406 is affixed to the exterior, center top region of the firearm holster front panel 402 providing a means for quickly accessing contents stored within the holster pocket 450. A top center fastener 424 comprising a first coupling portion 424*a* and a second coupling portion 424*b* can be affixed to the interior, center top region of each of the panels 402, 432 providing an additional quick release, closure mechanism. The firearm 160 is placed into the holster 162 and inserted into the holster pocket 450, being secured via a pocket rear internal fastening panel 418. The pocket rear internal fastening panel 418 is affixed to the interior of the rear pocket front panel 432.

The chest firearm holster 400 is placed and secured onto the wearer 100 via a plurality of straps. A neck strap 408 is incorporated for securing the chest firearm holster 400 to the wearer 100 about their neck. The neck strap 408 are affixed to and projecting upwards from each of a left and right upper corner of the firearm holster rear panel 430. A neck strap adjusting hardware 410 is incorporated along the length of the neck strap 408 providing an adjusting and optional securing means. The neck strap adjusting hardware 410 can be a length adjusting buckle, a coupling buckle, or both. The lower portion of the chest firearm holster 400 is secured to the wearer 100 about the wearer's 100 waist via a waist strap 412. The waist strap 412 is affixed to each of a left and right lower region of the panels 402, 430. A waist strap buckle 416 is incorporated along the length of the waist strap 412 providing an adjusting and optional securing means. The waist strap buckle 416 can be a length adjusting buckle, a coupling buckle, or both. Holster winglets 414 can be incorporated between the waist strap 412 and the panels 402, 430 proving comfort to the wearer 100 and improved reliability to the chest firearm holster 400. The panels 402, 430, can have a holster vertical side 420 or a holster tapered side 422. The chest firearm holster 400 incorporating the holster tapered side 422 design minimizes any buckling of the panels 402, 403.

Figure 23:
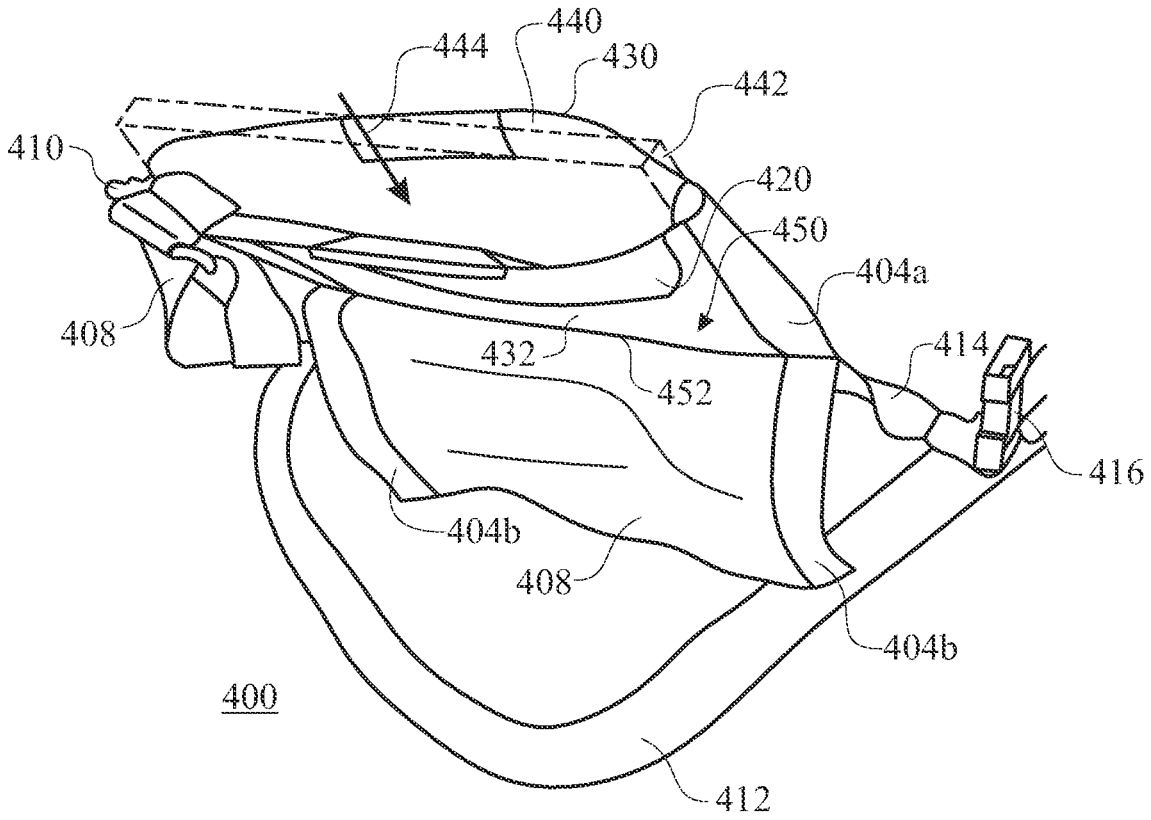
Figure 24:
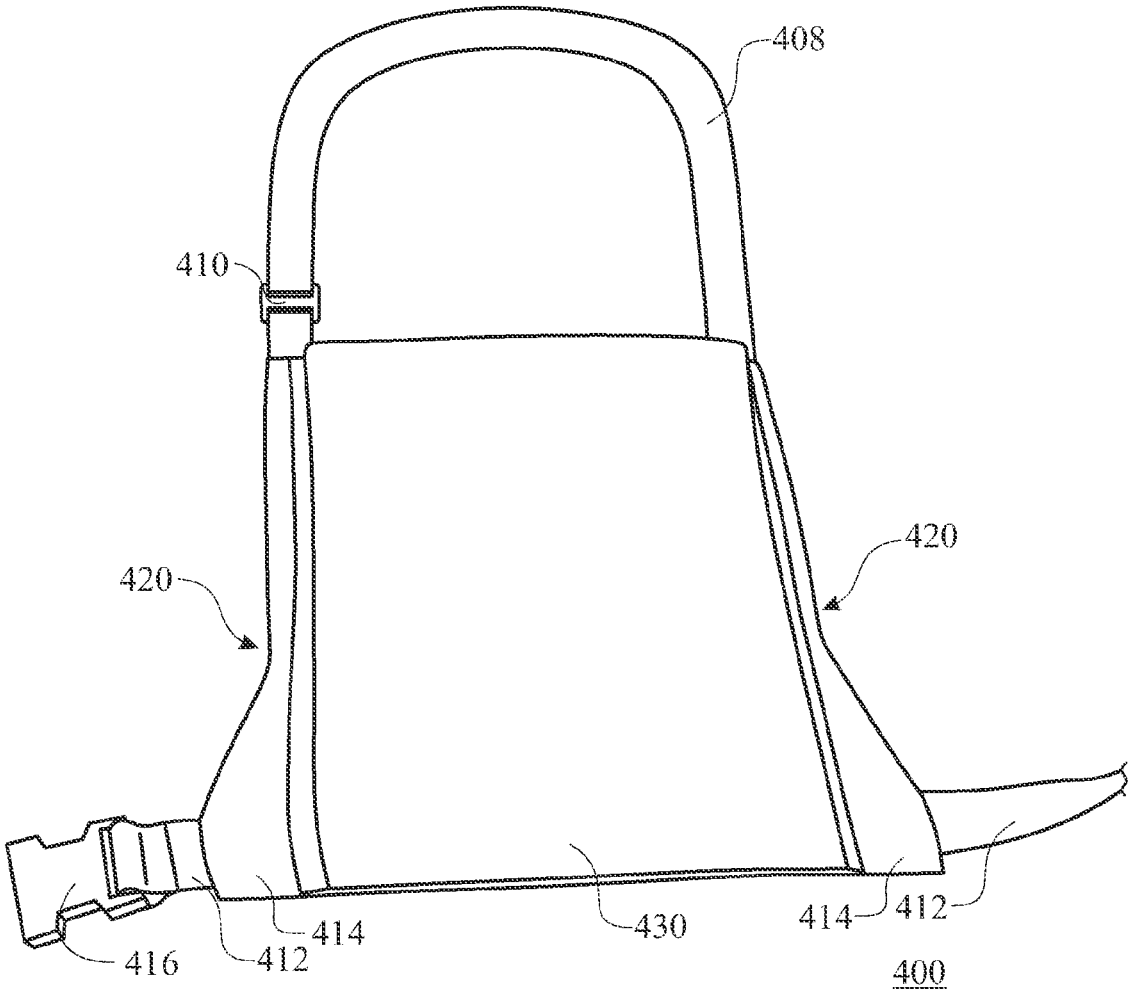
FIG. 24 is a rear view of the exemplary chest firearm holster of FIG. 20.
Figure 25:
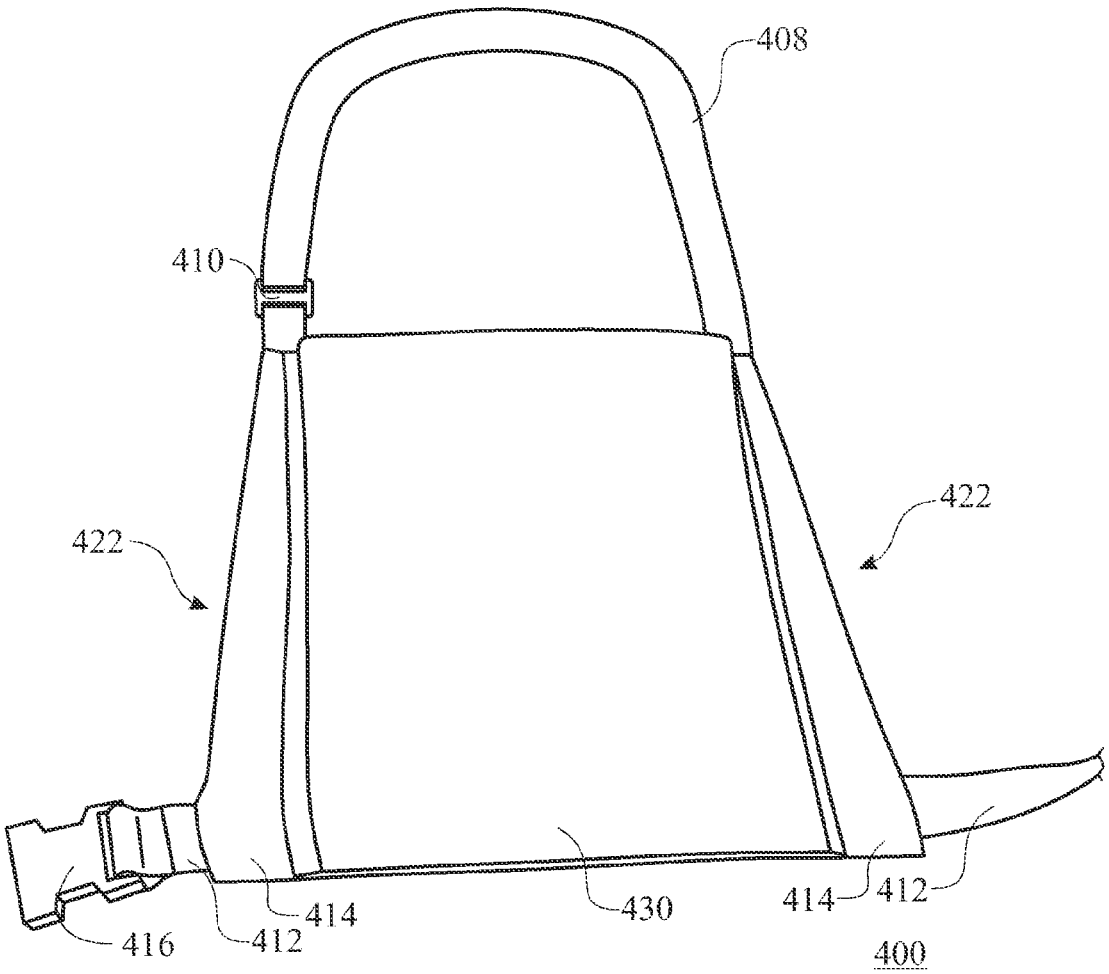
FIG. 25 is a rear view of the exemplary chest firearm holster of FIG. 21.

The rear pocket 440 can optionally be included as illustrated in FIG. 23. The rear pocket 440 is formed between the firearm holster rear panel 430 and the rear pocket front panel 432 providing for insertion 444 of a padded insert 442 (or other device) into the rear pocket 440. The padded insert 442 is fabricated of foam, rubber, or other padded material and provides additional comfort and safety to the wearer 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A ballistic vest and chest holster apparatus combination, the combination comprising:

a ballistic vest comprising:

a rear torso protection panel having at least one waist strap extending from each side thereof, each waist strap comprising a section of waist strap engaging material, and an abdomen protection panel having a section of mating waist strap engaging material spanning across a lower region thereof, a first shoulder strap and a second shoulder strap extending between the rear torso protection panel and the abdomen protection panel; and a chest holster apparatus removably attachable to the ballistic vest, the chest holster apparatus comprising:

a front panel and a rear panel, the front panel and rear panel being connected along a lower edge;

a quick release fastening feature disposed upon facing left and right sides of each of the front and rear panels, a firearm pocket being formed between the coupled front and rear panels upon fastening the quick release fastening feature;

a pocket to vest securing feature disposed upon a lower portion of an exterior side of the rear panel, the pocket to vest securing feature being compatible for coupling with the mating waist strap engaging material of the ballistic vest abdomen protection panel;

a front coupling feature affixed to a lower portion of an exterior side of the front panel, the front coupling feature being compatible for coupling with the waist strap engaging material of the at least one waist strap of the ballistic vest;

a pocket internal fastening material disposed upon an interior side of the rear panel;

a first securing strap and a second securing strap, respectively extending from an upper right portion and an upper left portion of the rear panel, the first securing strap and second securing strap comprising a respective strap fastener arranged at a distal portion of the strap, at least one of the first securing strap and the second securing strap wrapping around one of the shoulder straps and being coupled to the pocket internal fastening material.

2. The ballistic vest and chest holster apparatus combination of claim 1, wherein the strap fasteners of the first and second securing straps are one portion of a dense hook and loop fastening feature, and the pocket internal fastening material is a mating portion of a dense hook and loop fastening feature.

3. The ballistic vest and chest holster apparatus combination of claim 1, wherein the pocket to vest securing feature of the chest holster apparatus is one portion of a dense hook and loop fastening feature, and the front coupling feature of the chest holster apparatus is a mating portion of a dense hook and loop fastening feature.

4. The ballistic vest and chest holster apparatus combination of claim 1, further comprising a finger pull affixed to an upper portion of the chest holster apparatus front panel.

5. The ballistic vest and chest holster apparatus combination of claim 1, further comprising a quick release fastening feature disposed upon facing top sides of each of the front and rear panels of the chest holster apparatus, positioned proximate a center of a top portion of said front and rear panels.

6. The ballistic vest and chest holster apparatus combination of claim 1, further comprising a firearm holster removably attachable to the pocket internal fastening material of the chest holster apparatus.

7. The ballistic vest and chest holster apparatus combination of claim 1, wherein the chest holster apparatus further comprises a trauma pad including a plate fastening strip, wherein the trauma pad plate fastening strip is configured to removably attach to a pocket front internal fastening strip affixed to an interior side of the front panel of the chest holster apparatus when the trauma pad is inserted into the firearm pocket delimited between the coupled front and rear panels of the chest holster apparatus.

8. A method for removably attaching a chest holster apparatus to a ballistic vest, the ballistic vest comprising a rear torso protection panel having at least one waist strap extending from each side thereof, each waist strap comprising a section of waist strap engaging material, and an abdomen protection panel having a section of mating waist strap engaging material spanning across a lower region thereof, the ballistic vest further comprising a first shoulder strap and a second shoulder strap extending between the rear torso protection panel and the abdomen protection panel, the method comprising the steps of:

obtaining a chest holster apparatus comprising:

a front panel and a rear panel, the front panel and rear panel being connected along a lower edge;

a quick release fastening feature disposed upon facing left and right sides of each of the front and rear panels, a firearm pocket being formed between the coupled front and rear panels upon fastening the quick release fastening feature;

a pocket to vest securing feature disposed upon a lower portion of an exterior side of the rear panel;

a front coupling feature affixed to a lower portion of an exterior side of the front panel; wherein the front coupling feature is compatible for coupling with the pocket to vest securing feature;

a pocket internal fastening material disposed upon an interior side of the rear panel;

a first securing strap and a second securing strap, respectively extending from an upper right portion and an upper left portion of the rear panel, the first securing strap and second securing strap comprising a respective strap fastener arranged at a distal portion of the strap, the strap fasteners being compatible for coupling to the pocket internal fastening material;

removably attaching the pocket to vest securing feature of the chest holster apparatus rear panel to the mating waist strap engaging material of the ballistic vest abdomen protection panel;

extending the first securing strap of the chest holster apparatus around the first shoulder strap of the ballistic vest, and forming a first releasable connection between the strap fastener of the first securing strap to the pocket internal fastening material;

extending the second securing strap of the chest holster apparatus around the second shoulder strap of the ballistic vest, and forming a second releasable connection between the strap fastener of the second securing strap and the pocket internal fastening material;

forming a firearm pocket by coupling the quick release fastening feature on the left and right sides of the front panel and rear panel of the chest holster apparatus; wherein the first and second releasable connections are internal to the firearm pocket and concealed by the chest holster apparatus front panel and rear panel.

9. The method of claim 8, further comprising the step of:

attaching the section of waist strap engaging material of the at least one waist strap of the ballistic vest to the front coupling feature of the chest holster apparatus front panel.

10. The method of claim 8, further comprising the steps of fastening a quick release fastening feature disposed upon facing top sides of each of the front and rear panels of the chest holster apparatus, positioned proximate a center of a top portion of said front and rear panels.

11. The method of claim 8, further comprising the step of removably attaching a firearm holster to the pocket internal fastening material.

12. The method of claim 8, further comprising the steps of:

inserting a trauma pad between the front panel and rear panel of the chest holster apparatus, the trauma pad including a plate fastening strip;

removably attaching the plate fastening strip to a pocket front internal fastening strip affixed to an interior side of the front panel of the chest holster apparatus.

* * * * *